US008991920B2

(12) United States Patent
Oren et al.

(10) Patent No.: US 8,991,920 B2
(45) Date of Patent: Mar. 31, 2015

(54) INFANT BOUNCER

(71) Applicant: Tiny Love Ltd., Tel Aviv (IL)

(72) Inventors: Shoshana Oren, Herzeliya (IL); Giora Shachal, Tel Aviv (IL)

(73) Assignee: Tiny Love Ltd., Tel Aviv (IL)

( * ) Notice: Subject to any disclaimer, the term of this patent is extended or adjusted under 35 U.S.C. 154(b) by 0 days.

(21) Appl. No.: 13/770,756

(22) Filed: Feb. 19, 2013

(65) Prior Publication Data

US 2013/0214573 A1 Aug. 22, 2013

Related U.S. Application Data

(60) Provisional application No. 61/601,263, filed on Feb. 21, 2012.

(51) Int. Cl.
*A47D 13/10* (2006.01)
*A47D 1/02* (2006.01)
*A47C 4/28* (2006.01)

(52) U.S. Cl.
CPC ..... *A47D 1/02* (2013.01); *A47D 13/107* (2013.01)
USPC ..... 297/274; 297/16.1; 297/16.2; 297/45

(58) Field of Classification Search
USPC ..... 297/16.1, 16.2, 45, 260.1, 260.2, 274
See application file for complete search history.

(56) References Cited

U.S. PATENT DOCUMENTS 2,133,561 A * 10/1938 Thornton-Norris ..... 5/98.3
2,252,224 A * 8/1941 Welsh ..... 297/274
2,425,195 A * 8/1947 Lenthall ..... 280/644
2,618,318 A * 11/1952 Welsh ..... 297/274 X
2,691,410 A * 10/1954 Boucher ..... 297/45
2,758,634 A * 8/1956 Welsh et al. ..... 297/274 X
3,124,387 A 3/1964 Maclaren
3,656,728 A * 4/1972 Griggs ..... 248/585
4,105,244 A * 8/1978 Colby ..... 297/45
5,499,857 A * 3/1996 Lynch, Jr. ..... 297/16.2
5,570,928 A * 11/1996 Staunton et al. ..... 297/45 X
5,694,655 A * 12/1997 Shepler et al. ..... 5/105
5,718,473 A * 2/1998 Lynch, Jr. ..... 297/16.2
6,540,290 B2 * 4/2003 Liu ..... 297/45
6,550,855 B2 * 4/2003 Liu ..... 297/45 X
7,255,393 B2 * 8/2007 Flanagan ..... 297/274 X
8,708,875 B2 * 4/2014 Prohaska et al. ..... 297/274 X
2004/0217643 A1 11/2004 Piwko, Jr. et al.
2009/0167063 A1 7/2009 Brunner
2010/0026056 A1 2/2010 Yul
2012/0235450 A1 9/2012 Oren et al.

FOREIGN PATENT DOCUMENTS

CN 201260523 6/2009

OTHER PUBLICATIONS

U.S. Appl. No. 61/601,263, filed Feb. 21, 2012, Oren, et al.

* cited by examiner

*Primary Examiner* — Rodney B White
(74) *Attorney, Agent, or Firm* — Dorsey & Whitney LLP

(57) ABSTRACT

A collapsible infant bouncer comprising support assembly configured with a pair of intersecting support rods pivotally articulated to one another, each support rod configured with at least a top link and a bottom link foldable about a folding joint, and a flexible seating member mounted on the support assembly.

20 Claims, 20 Drawing Sheets

INFANT BOUNCER

CROSS-REFERENCE TO RELATED APPLICATIONS

This applications claims priority to U.S. Provisional Application No. 61/601,263 filed on 21 Feb. 2012, the disclosure of which is incorporated herein, in its entirety, by this reference.

TECHNICAL FIELD

The present disclosed subject matter relates to infant bouncers and more particularly the disclosed subject matter is concerned with a foldable infant bouncer.

The term bouncer as used herein the specification and claims denotes an infant seating device, often referred to also as an infant seat, rocker, etc.

BACKGROUND

Infant support seats are well known and among those are bouncers, configured for supporting an infant at a reclining or upright position, or at intermediate positions, whilst capable of rocking/bouncing for imparting a soothing effect to the infant.

One example is disclosed in U.S. Patent Application Publication No. 20040217643 relating to an infant seat, and in particular, to an infant seat that provides a stable, enhanced seating position for an infant and includes a sensory stimulus unit with a slide switch that, when actuated, effectuates a change in visual appearance of the stimulus unit and a corresponding change in the sensory output.

Another example is disclosed in U.S. Patent Application Publication No. 20120235450, directed to an infant seat comprising an upper torso support, a lower torso support pivotally articulated to the upper torso support and a seat supporting structure; at least one of the upper torso support or the lower torso support is pivotally articulated to the seat supporting structure, the seat further comprising a converting mechanism for converting the seat between at least an angular position in which the upper torso support is inclined with respect to the lower torso support, and a planar position in which the upper torso support and the lower torso support are substantially co-planar.

SUMMARY

It is an object of the present disclosed subject matter to provide a sturdy and firm, yet light weight infant bouncer, and configured for easy folding into a compact sized collapsed position, however easily deployable into its operative seating position.

According to the disclosed subject matter there is provided a collapsible infant bouncer comprising support assembly configured with a pair of intersecting support rods pivotally articulated to one another, each support rod configured with at least a top link and a bottom link foldable about a folding joint, and a flexible seating member mounted on the support assembly.

The bouncer is configurable between an open position at which the top link of the support rods are retained at an intersecting, X-like configuration, and the top link and the bottom link of each support rod are substantially coextensive, and a collapsed position at which the top links are folded over the bottom links, and the bottom link of the support rods are adjoined and substantially parallel disposed.

According to one particular configuration each of the support rods has a J-like shape, and wherein the bottom link is substantially U-like shaped.

Any one or more of the following features, designs and configurations can be incorporated in the infant bouncer according to the present disclosed subject matter, independently or in combinations thereof:

- The free ends of the support rods serve for mounting thereon the flexible seating member, wherein at the open position at least portions of the flexible seating member are stretched so as to assume a seating shape, configured for comfortably seating an infant therein, wherein at the collapsed position, the seating member folds to occupy minimal space;
- A top portion of the seating member is secured over a free top end of the top links of the support rods, and a bottom portion of the seating member is secured over a free bottom end of the bottom links of the support rods;
- The seating member can be detachably attachable to the support assembly;
- The seating member can be made of pliable sheet material;
- The seating member can be a non-stretchable sheet material;
- The seating member can be configured for use at either a first or a second face thereof;
- The seating member can be configured with receiving pockets for mounting over the free ends;
- The seating member can be configured with a securing arrangement such as a harness or safety straps for securing an infant to the bouncer;
- The support rods can be made of a rigid light weight material, e.g. metal, reinforced plastic material, carbon, etc.;
- A joint end of one of the top link and the bottom link of a support rod can be fixedly secured to the folding joint, and a neighboring joint end of another one of the top link and the bottom link is pivotally secured to the folding joint;
- A pivoting one of the top link and the bottom link can be configured for snap locking at the folding joint in either or both of an open position in which the top link and the bottom link substantially coextend, and the collapsed position;
- Folding joint can be configured with a safety snap to prevent unintended collapsing of the links;
- The folding joint can be configured with a gliding surface for smooth displacement of a locking mechanism of the one of the top link and the bottom link over a wall surface of the folding joint;
- The folding joint can be configured for locking arresting at the open position by a normally locked arresting mechanism, such that when deployed at the fully open position the top link and the bottom link become a rigid element' substantially continuous with one another;
- The arresting mechanism can be a configured as a hooked member articulated with one of the top link and the bottom link, and configured for arresting a respective recess configured at the other one of the top link and the bottom link;
- According to one particular design, the top link is fixedly articulated to the folding joint and the bottom link is pivotally articulated to the folding joint. According to yet a particular arrangement, the bottom link is configured with an arresting recess for arresting engagement with a pivoting hook member associated with the top link;
- The pivoting hook member is normally biased into a normally locked position;

An unlocking mechanism is configured at a pivot location of the two respective top links, said unlocking mechanism configured for simultaneous manipulating of the arresting mechanism at the folding joints;

The unlocking mechanism is configured with a biasing arrangement for biasing the pivoting hook members into their respective locked/arresting position;

Displacement of the pivoting hook members by the unlocking mechanism is facilitated by a cord member articulated to the hook members and to the unlocking mechanism, whereby manipulating the unlocking mechanism entails temporarily unlocking of the hook members so as to disengage from the respective arresting recess;

Manipulating the unlocking mechanism can be by rotating same to pull a cord/cable, said cord extending through at least a portion of the top links;

The unlocking mechanism is configured with a spring for biasing the pivoting hook members into their locked position;

The pivoting hook members and/or the respective arresting recess are configured with gliding surfaces to facilitate smooth displacement of the hook members into arresting engagement of the arresting recess;

A joint end of both the top link and the bottom link of a support rod can be pivotally secured to the folding joint, displaceable between an open position in which the top link and the bottom link substantially coextend, and the collapsed position;

At least a portion of the bottom link of the support rods can be configured with or made of an elastic material, to thereby facilitate gentle rocking of the bouncer. According to one particular configuration the bouncer is configured with springy supports to thereby facilitate gentle rocking of the bouncer;

A top portion of the top links and a bottom portion of the bottom links can be configured with a seat arresting member for securing the seat member thereto. The seat portion arresting member according to one configuration is a clamp configured for arresting the seat to a respective link portion and according to another configuration the seat arresting member is a fastener for arresting a loop of the seat portion;

Locations of the support rods can be configured for resting over a floor surface are fitted with floor pads. Such floor pads serve as anti-slip and anti-scratch pads;

At the open position of the bouncer the free bottom ends of the bottom links can be extend substantially upright. However said free bottom ends can be configured to project offset from a longitudinal axis of the open bouncer, in an outwards or inwards orientation;

A connecting member extends between a portion of each of the two bottom links, to restrict expansion of the two support rods at the open position of the bouncer;

According to one configuration the connecting member can be a strap of flexible material extending between a bottom portion of the bottom links;

According to another configuration the connecting member can be configured with two or more support links pivotally secured to a bottom location of bottom links and to one another, said support links deployable between a collapsed position at which they at least partially overlap, and an open position at which they substantially coextend;

The support links can be configured with a locking mechanism for arresting the connecting member at the open position, to thereby retain the bouncer at the open position and prevent spontaneous folding thereof;

The locking mechanism can be configured to prevent spontaneous opening of the support links into the deployed, open position;

BRIEF DESCRIPTION OF THE DRAWINGS

In order to understand the present disclosed subject matter and to see how it may be carried out in practice, the disclosure will now be described, by way of non-limiting examples only, with reference to the accompanying drawings, in which.

DETAILED DESCRIPTION

Figure 1:
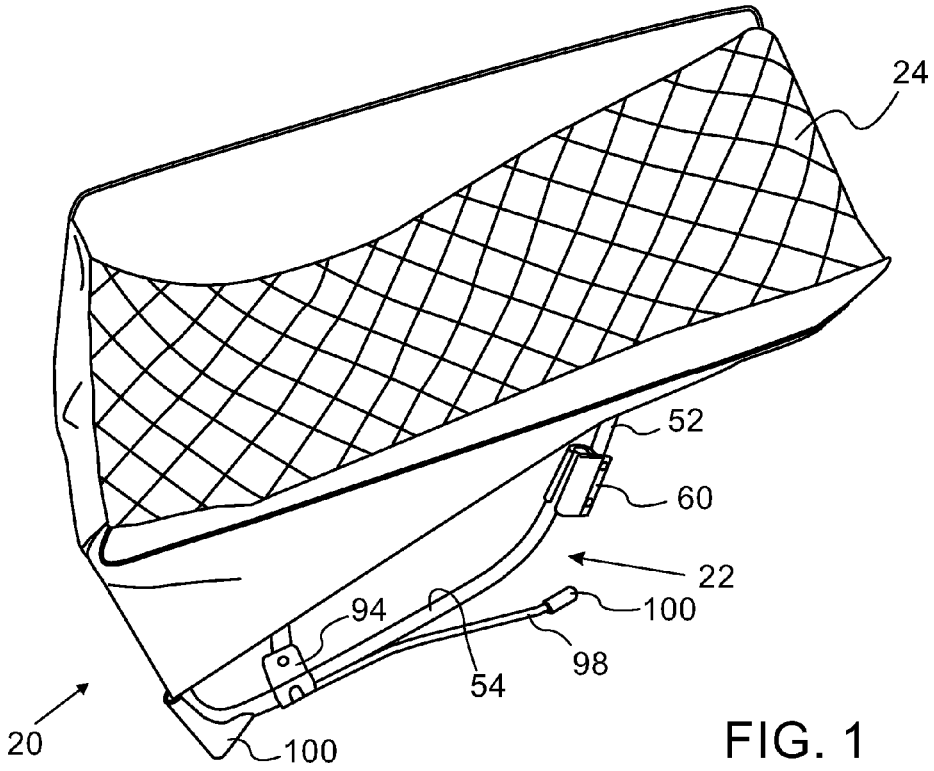
FIG. 1 is perspective view of the bouncer at its open position.
Figure 2A:
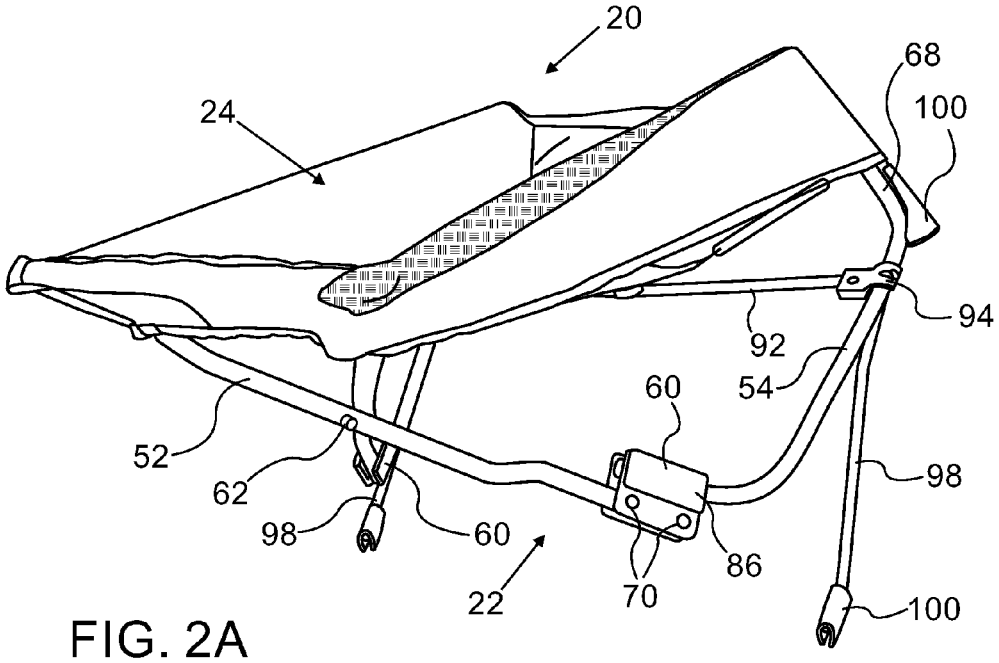
FIG. 2A is rear left perspective view of the bouncer at its open position.
Figure 2B:
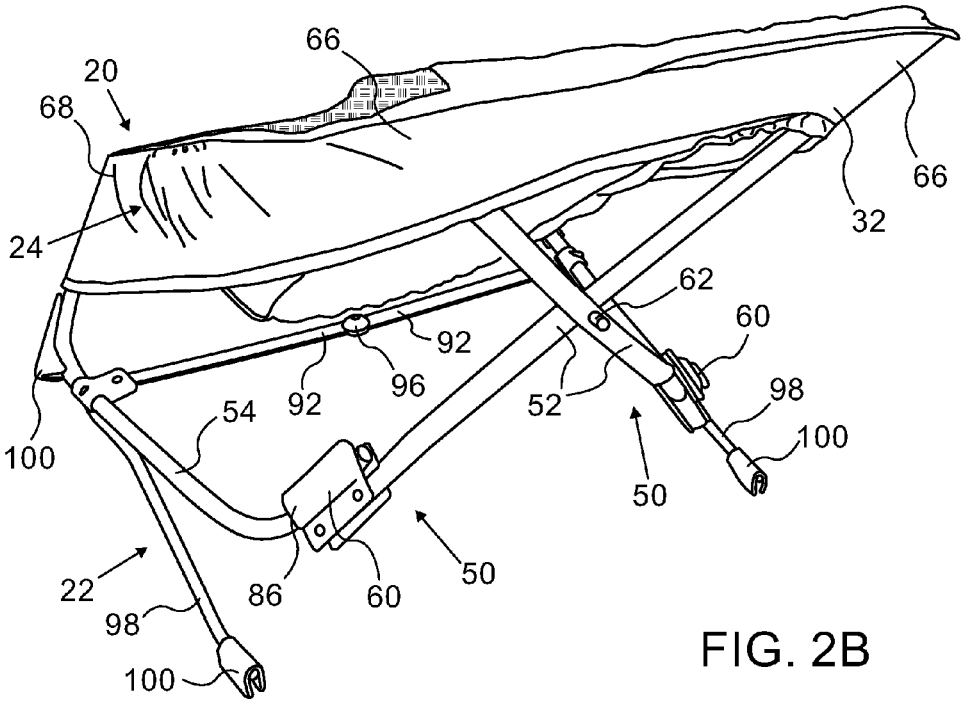
FIG. 2B is rear right perspective view of the bouncer at its open position.
Figure 2C:
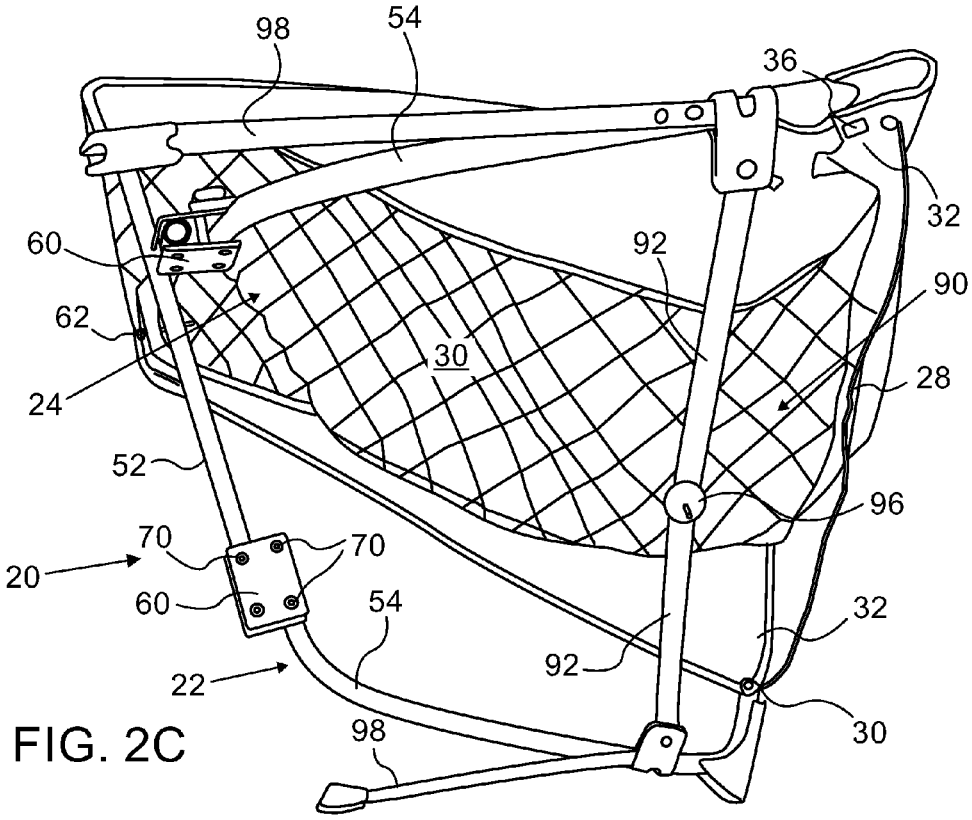
FIG. 2C is bottom view of the bouncer at its open position.
Figure 3:
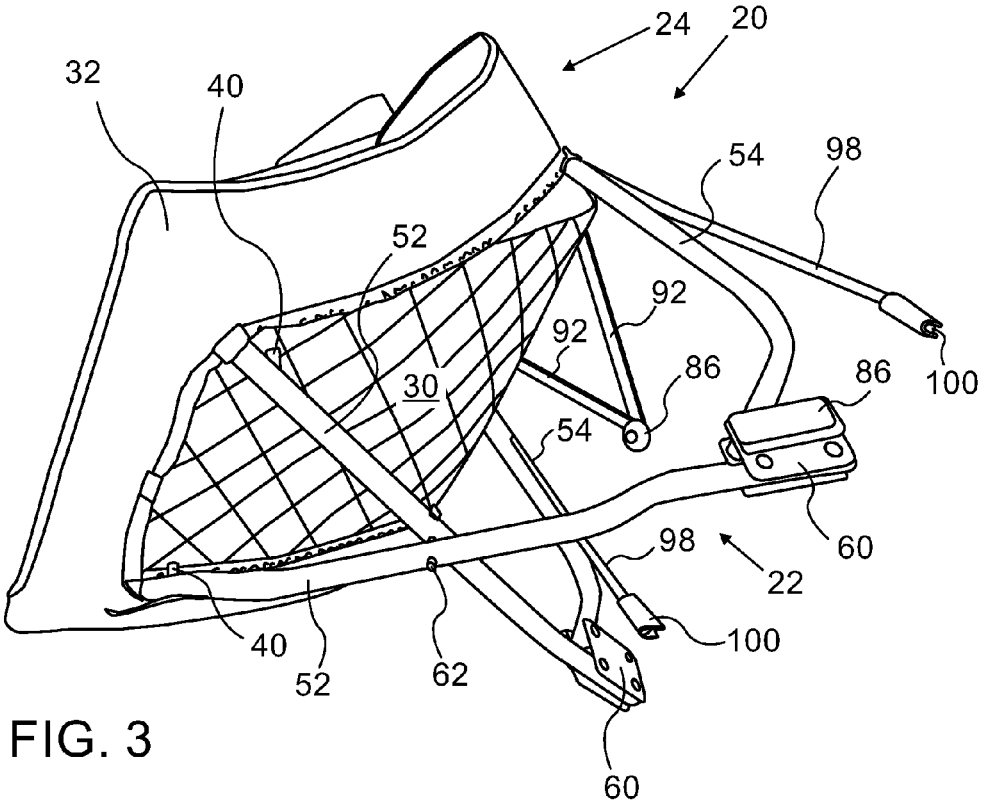
FIG. 3 is rear right perspective view of the bouncer at a first sequence of folding the bouncer.

Attention is directed to FIGS. 1 to 3 of the drawings illustrating a bouncer generally designated 20, comprising two principal components, namely a support assembly 22 and a seating member 24 mounted over the support structure 22.

Figure 4:
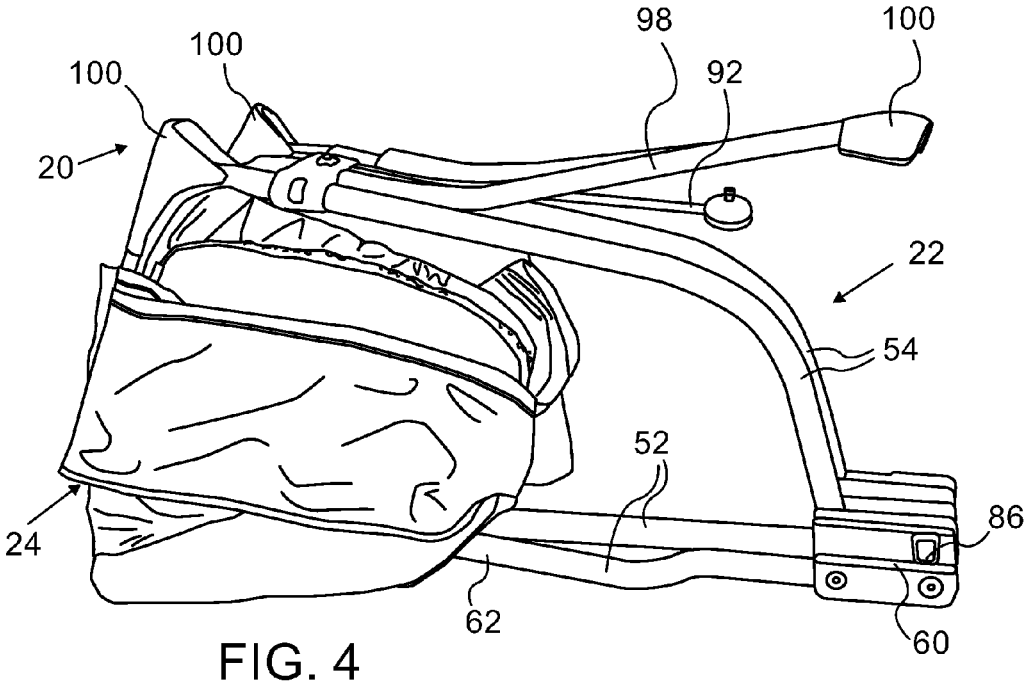
FIG. 4 is perspective view of the bouncer at its fully folded position.

In FIGS. 1 to 3 the bouncer 20 is illustrated at its fully open position, namely at its operative position configured for seating an infant. However, in FIG. 4 the bouncer 20 is illustrated at its fully collapsed/folded position wherein it occupies only little space rendering it suitable for carrying or stowing.

The seating member 24 is made of a flexible material, though non-stretchable material, e.g. fabric, optionally with one or more cushioned (padded) zones, and optionally made of or comprising portions made of so-called breathing fabrics, optionally net-like portions. The shape of the seating member 24 is designed for comfortably seating an infant (not shown), at a safe and comfortable position, supporting its entire body, i.e. head, torso and legs.

The seating member 24 can be used with either face facing upwards, i.e. it can be inverted for use with an alternative pattern or in case one face becomes dirty. A rim of the seating member 24 is configured with a reinforcing hem 28.

According to one particular example, and as seen best In FIG. 2C, a bottom side 30 of the seating member 24 comprises at each of its four corners a receiving pocket 32, for mounting over a free end of a respective link of the support structure 22. Also noted, at each respective corner of the seating member 24 there is configured an elastic band 36 for securing the seating member 24 to arresting members, namely knobs 40 fitted at respective ends of links of the support structure 22.

The arrangement is such that the seating member 24 is detachable mounted thereover, in a readily removable fashion. However, the seating member can be configured with a securing arrangement (not shown) such as a harness or safety straps for securing an infant to the bouncer.

Figure 5A:
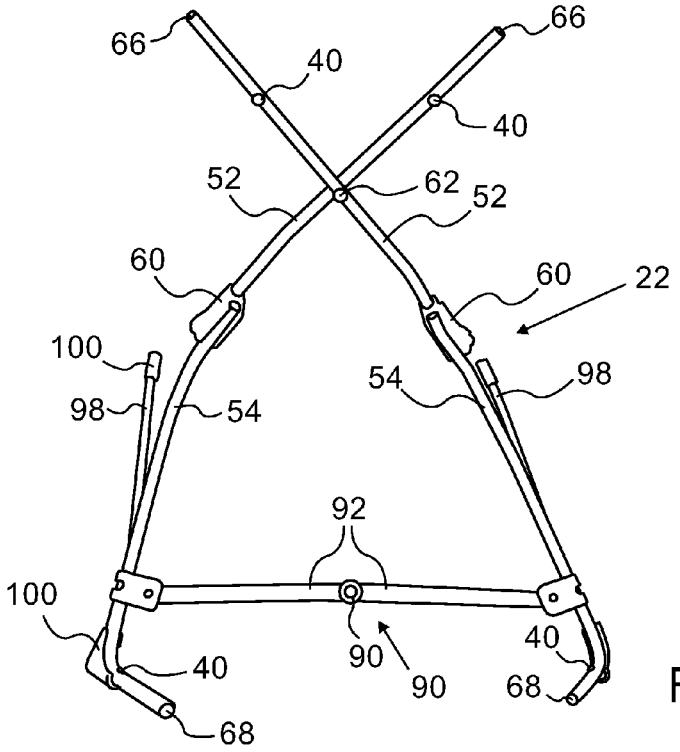
FIG. 5A is a front view of the support assembly of the bouncer, at the fully open position.
Figure 5B:
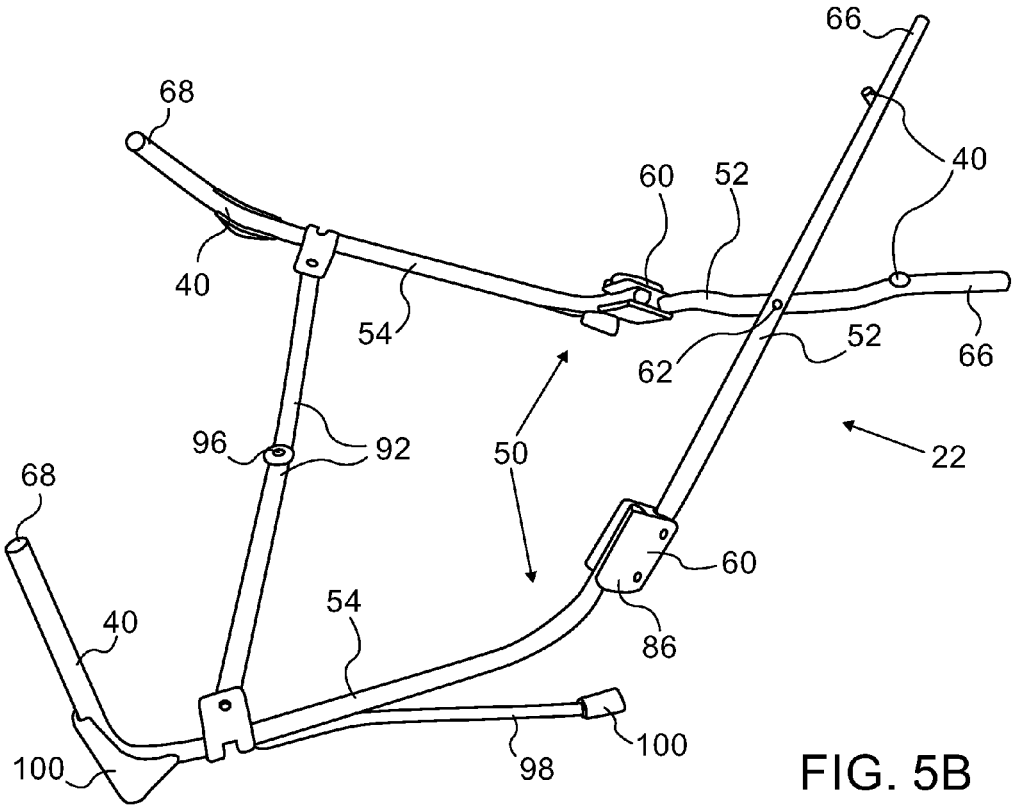
FIGS. 5B and 5C are right and left perspective views, respectively, of the support assembly of FIG. 5A.
Figure 5C:
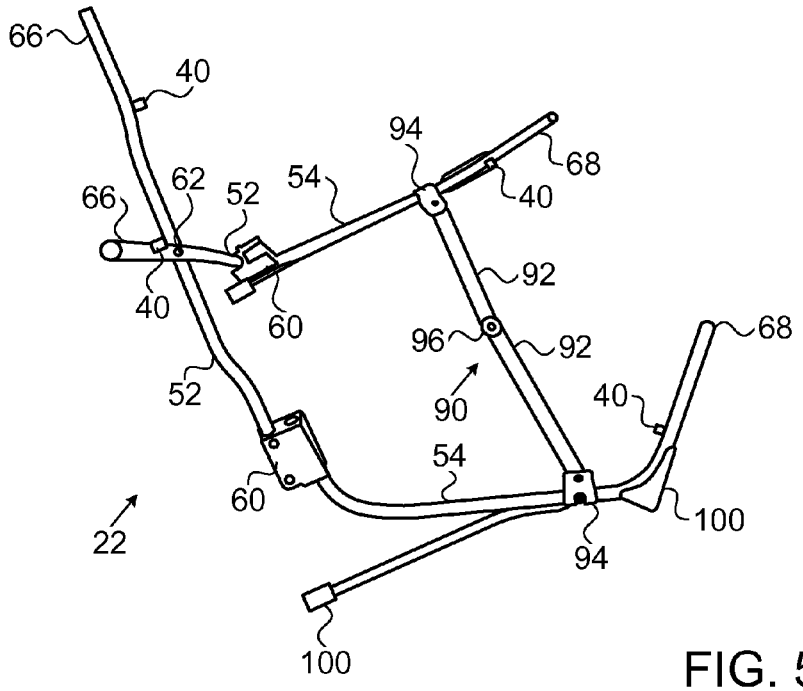

Turning now also to FIGS. 5A to 5C, the support structure 22 with the seating member 24 removed. As can be seen, the support structure 22 comprises two support rods 50 each configured as a J-like shaped member and comprising a top link 52 and a U-like bottom link 54 coupled to one another about a folding joint 60 to be discussed hereinafter in further detail. The two support rods 50 are pivotally secured to one another at 62 such that at an open position the top links intersect at an X-like configuration. The support rods 50 are made of a rigid light weight material, e.g. metal, reinforced plastic material, carbon, etc.

The support structure is thus configured with two top free ends 66 (of top links 52) and two bottom free ends 68 (of bottom links 54), said free ends shaped and sized for being received within the receiving pockets 32 of the seating member 24.

As can be seen in the drawings, at the open position of the support structure 22, the bottom free ends 68 of bottom links 54 extend substantially upright with a somewhat inwards oriented inclination. However, according to other configurations (not shown) the bottom links can extend with a somewhat outwards oriented inclination.

In the particular illustrated example, the arrangement is such that the top link 52 is fixedly secured to the folding joint 60, with the bottom link 54 being pivotally secured thereto. A locking mechanism is provided for arresting the bottom link 54 at the open position, i.e. substantially in continuity with the top link 62.

The seating member 24 and the corresponding free ends 66 and 68 of support rods 50 are shaped and sized such that at the open position the flexible seating member 24 is stretched and assumes a seating shape, configured for comfortably seating an infant therein, and at the collapsed position (FIG. 4), the bouncer is collapsed/folded and the support structure 22 with the articulated seating member 24 fold into a compact size to occupy minimal space.

As can be seen, best in FIGS. 8A to 8D, the folding joint 60 has a portion thereof fixedly attached to an end of the top ling 52 (by rivets 70 or otherwise), and a pivot point at 72 secured to the bottom link 54. The bottom link 54 is configured at an end portion thereof pivoted to the folding joint 60 with a snap-type locking pin 78, said locking pin 78 being spring biased to project from the bottom link 54 and configured for snappingly arresting within a locking receptacle 80 at the folding joint 60. Also noted, the folding joint 60 is configured with a gliding surface 84 to facilitate smooth sliding of the locking pin 78 into the locking receptacle 80. A release mechanism is provided by way of depression bar/knob 86, pressing of which entails depression of the locking pin 78 against the biasing spring so as to disengage from the locking receptacle 80, thereby facilitating folding/collapsing of the support rods 50.

Also seen in the Figures, a connecting member 90 extends between a portion of each of the two bottom links 54, to restrict expansion of the two support rods 50 at the open position of the bouncer.

Figure 9A:
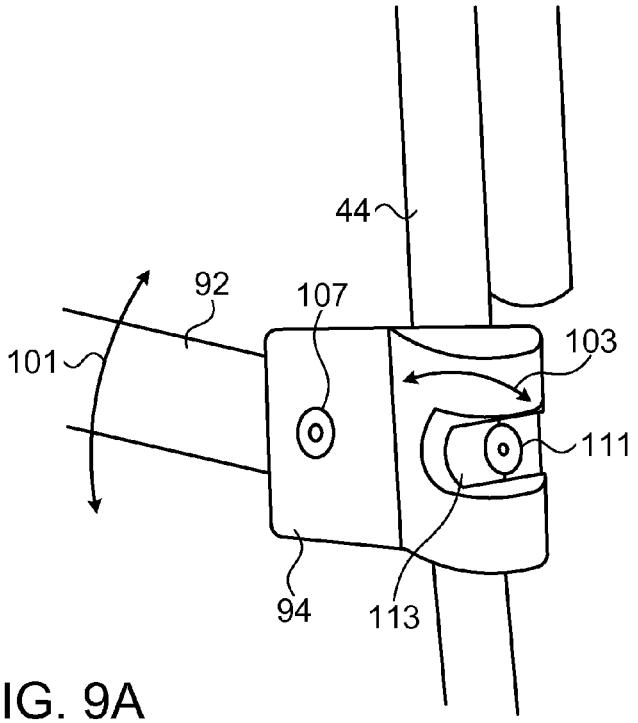
FIGS. 9A and 9B illustrate a pivotal coupling of a connecting member to the bottom link, at to respective angular positions.
Figure 9B:
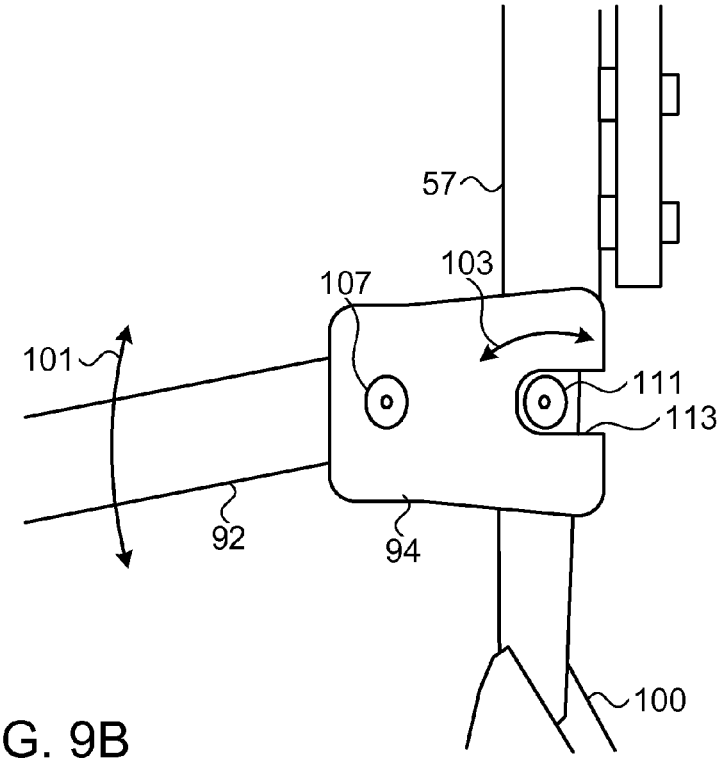
Figure 10A:
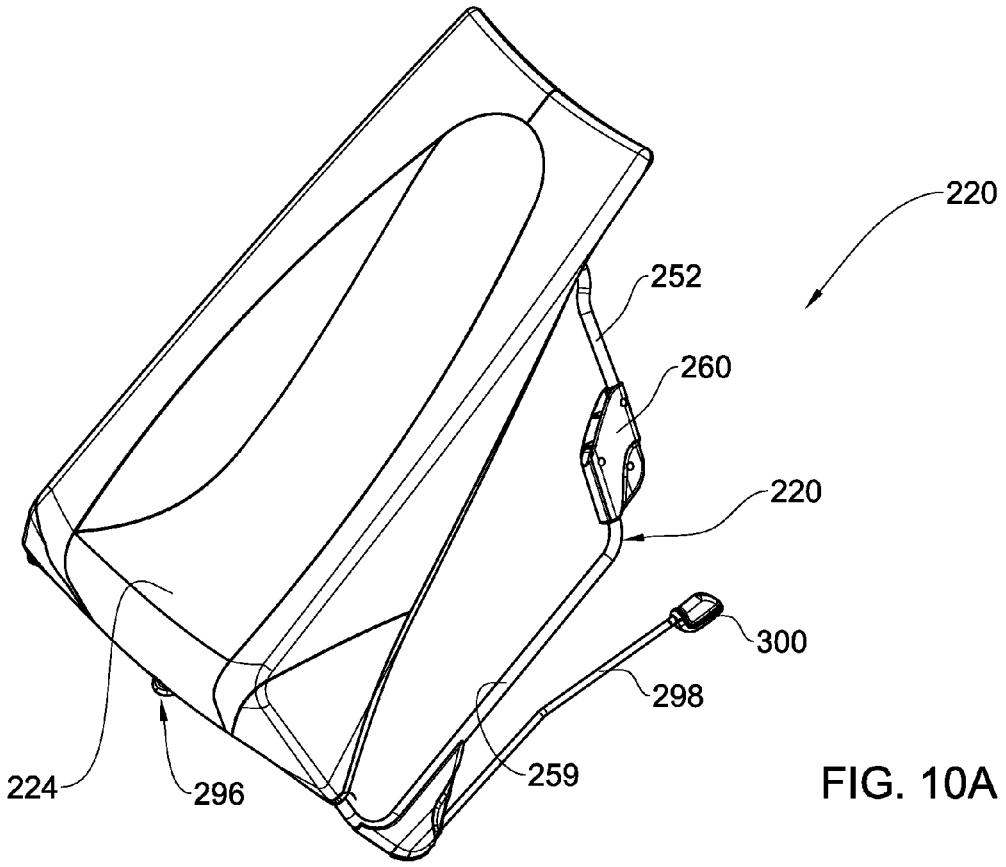
FIG. 10A is a front perspective view of a bouncer according to another example of the present disclosed subject matter, at its open position.
Figure 10B:
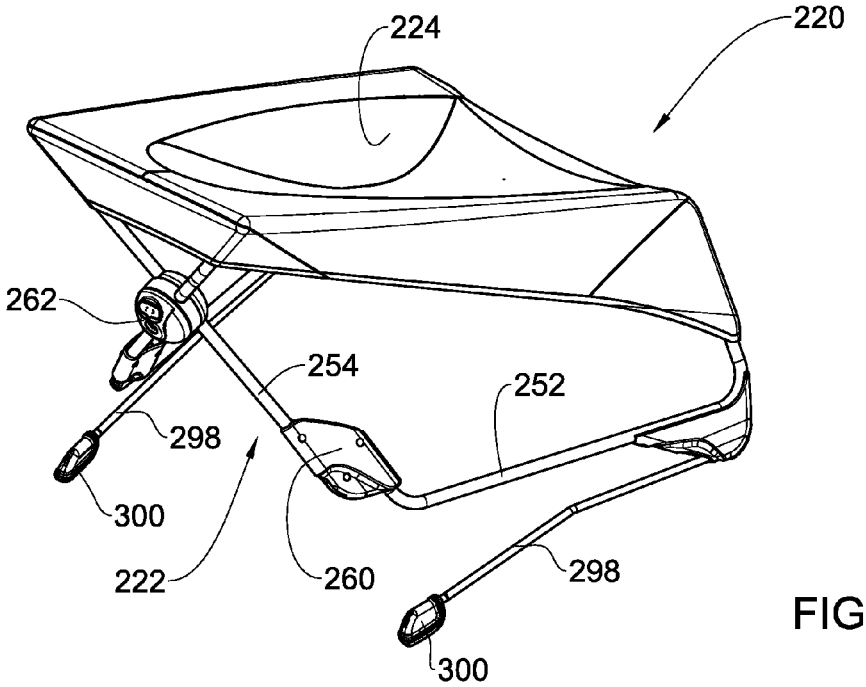
FIG. 10B is a front perspective view of the bouncer of FIG. 10A.
Figure 11:
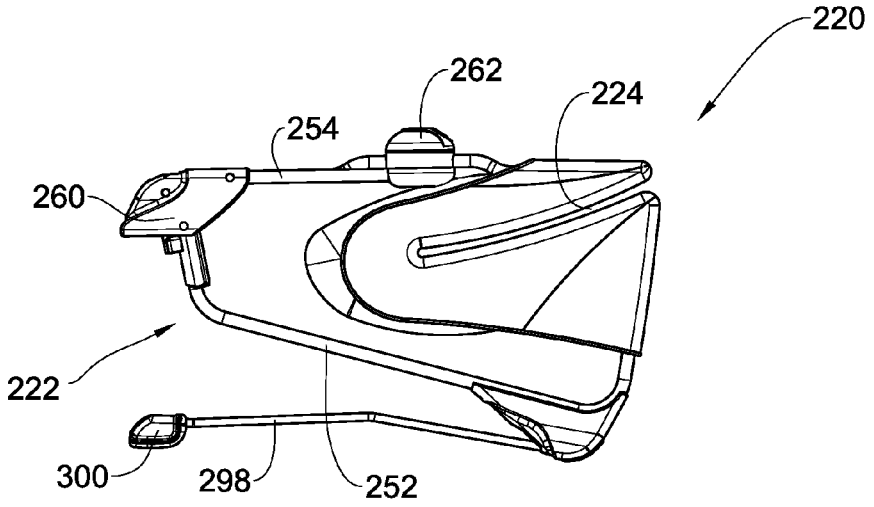
FIG. 11 is a side view of the bouncer at its closed position.
Figure 12A:
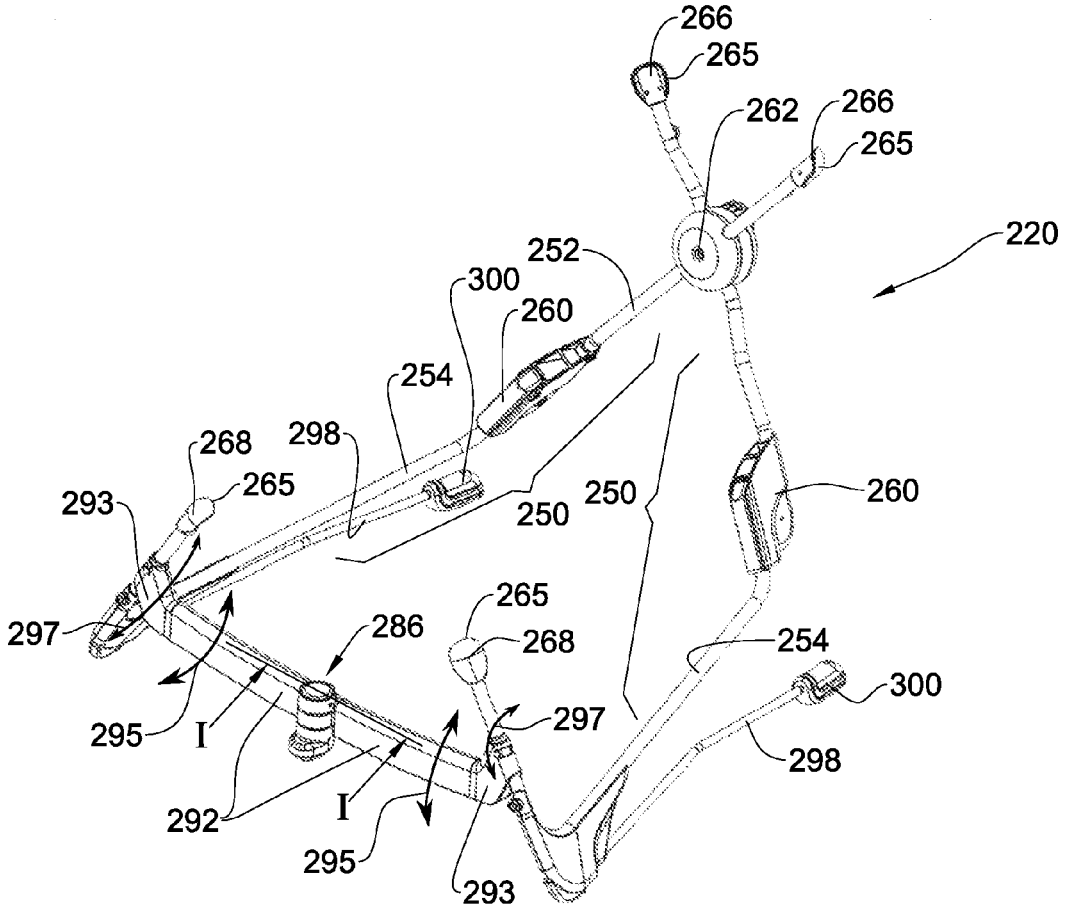
FIG. 12A is a front perspective view of the support assembly, at the fully open position.
Figure 12B:
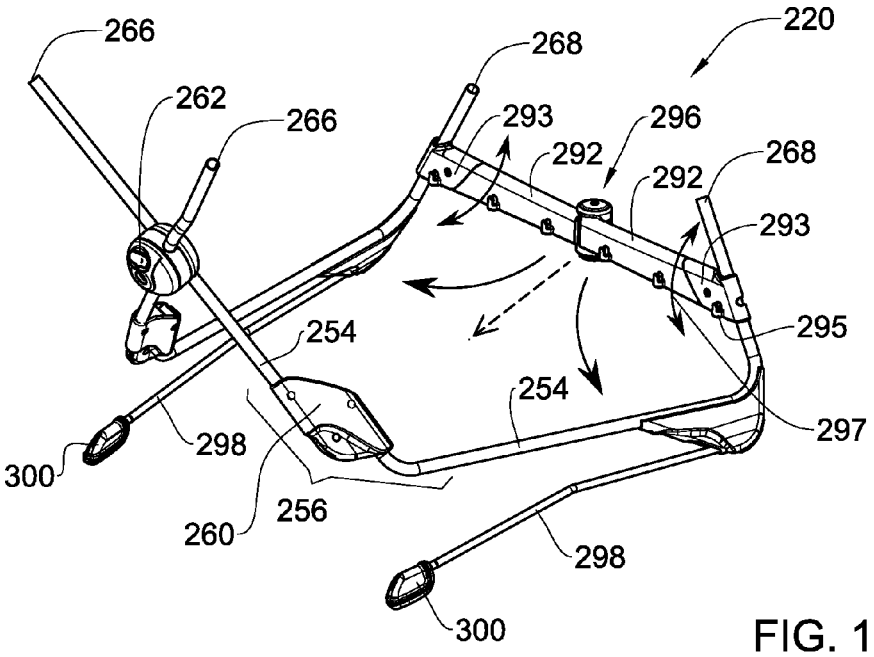
FIG. 12B is a rear perspective view of FIG. 12A.
Figure 13A:
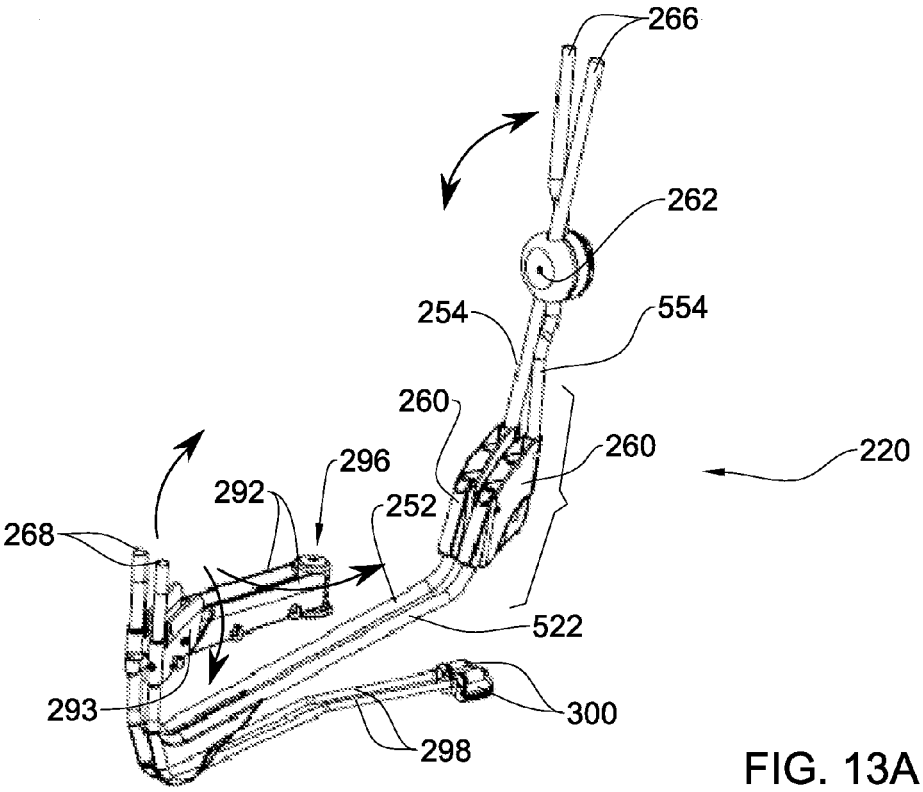
FIG. 13A is a right side, front perspective view of the support assembly, at a first folding position.
Figure 13B:
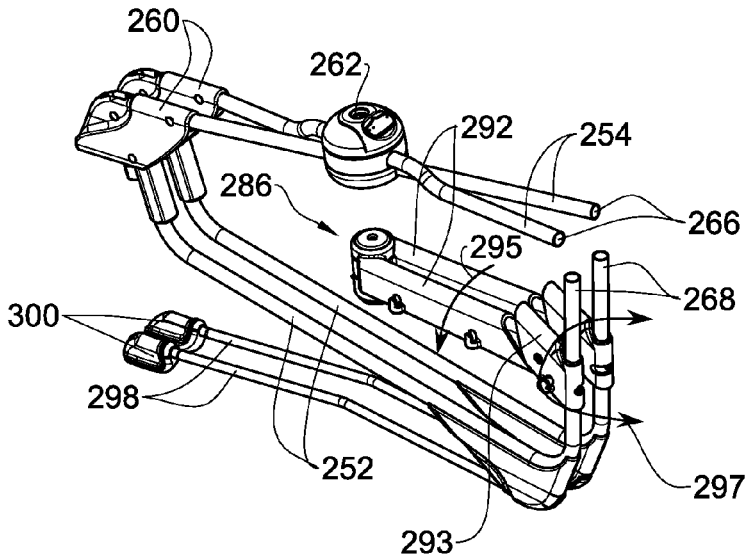
FIG. 13B is a left side, front perspective view of the support assembly, at a fully folded/collapsed position.
Figure 13C:
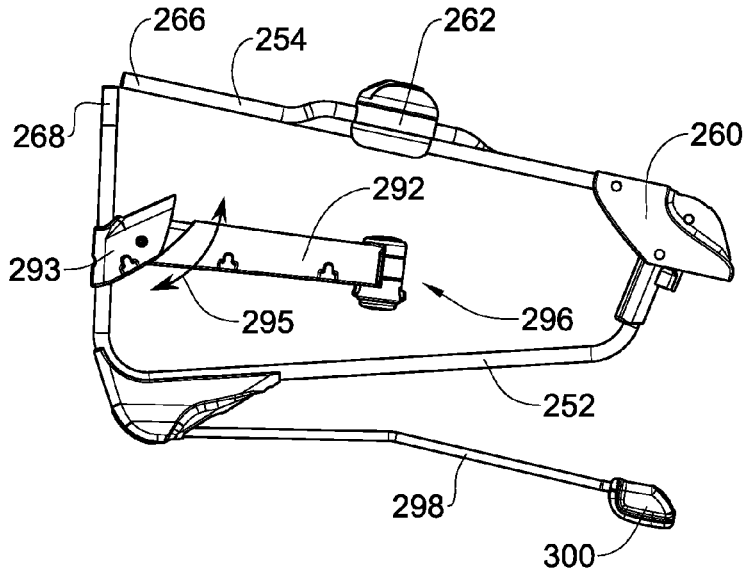
FIG. 13C is a side view of FIG. 13A.
Figure 13D:
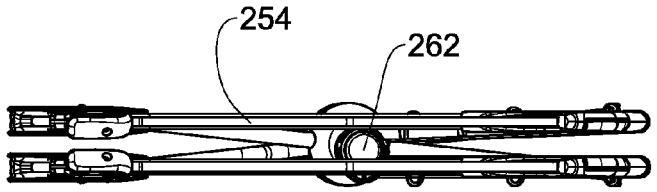
FIG. 13D is a bottom view of FIG. 13A.

According to the illustrated configuration, the connecting member 90 is configured with two support links 92 pivotally secured at a bottom location 94 of bottom links 54 and to one another at a pivot point 96, said support links 92 deployable between a collapsed position at which they at least partially overlap, and an open position at which they substantially coextend. It is appreciated that articulation of the support links 92 to the bottom link 54 at pivot link 94 is of the type facilitating both pivotal displacement of the links 92 about the pivot point 107 (arrow 101 in FIGS. 9A and 9B) and rotation of the pivot link 94 about the longitudinal axis of the bottom link 54 (arrow 103 in FIGS. 9A and 9B), whereby rotation of the pivot link 94 about the bottom link 54 is restricted by virtue of pin 111 extending from the bottom link 54 and projecting into a recessed opening 113 formed at the pivot link 94.

The support links can be configured with a locking mechanism (not shown) for arresting the connecting member at the open position, to thereby retain the bouncer at the open position and prevent spontaneous folding thereof. Alternatively, as in the illustrated example, the support links 92 assume a locked mechanism position at their fully open position, preventing their collapse.

According to another configuration (not illustrated) the connecting member is a strap of flexible material extending between a bottom portion of the bottom links.

In order to impart the bouncer 20 with some bouncing elasticity, for a rendering it a soothing effect, a pair of springy supports 98 are attached to the bottom links 54, to thereby facilitate gentle rocking of the bouncer.

A free end of said springy supports 98 and a floor point of contact at the bottom link is configured with a floor pad 100, e.g. made of rubber material or plastic, serving as an anti-slip and anti-scratch pad.

It is however appreciated that rather than supports 98, other configurations are possible, e.g. a resilient projection extending from or near each of the joints 60 (e.g. articulated to the bottom links 54), etc.

Figure 6A:
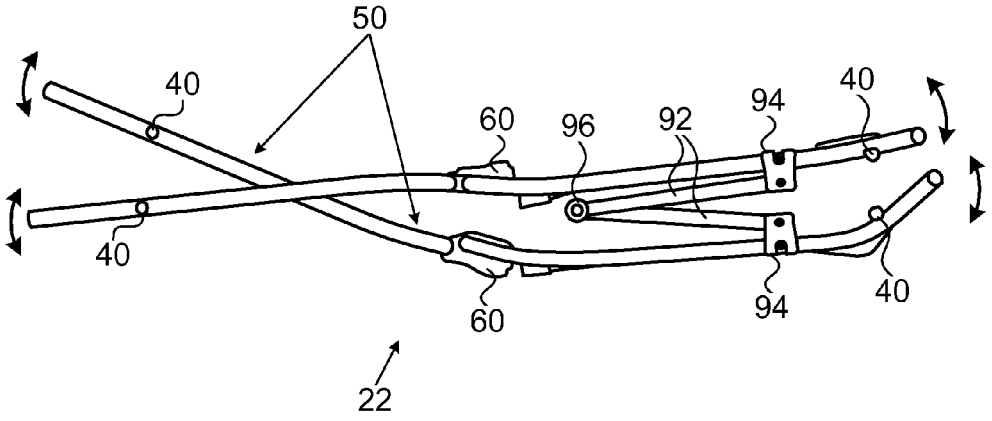
FIG. 6A is a top view of the support assembly of the bouncer, at a midway collapsed position.
Figure 6B:
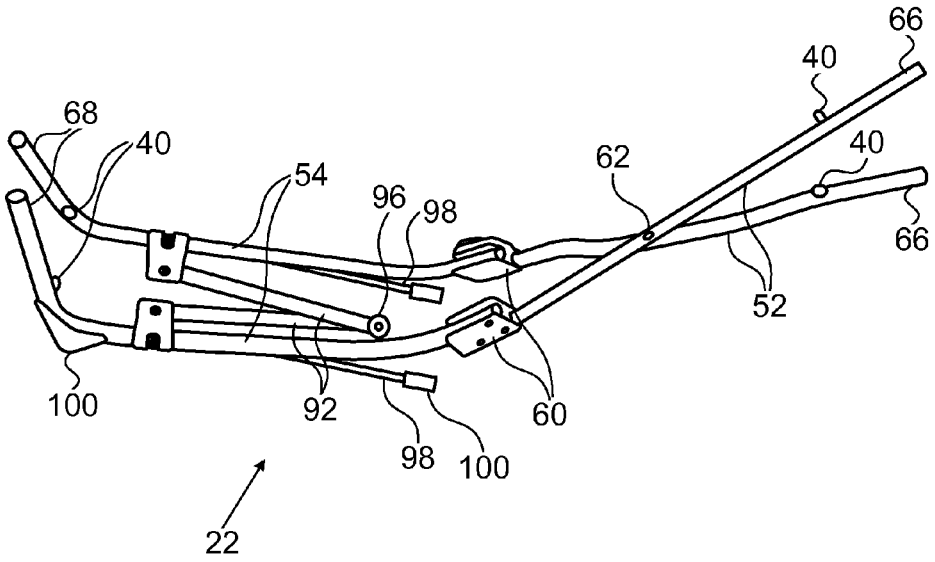
FIG. 6B is a right side perspective view of the support assembly of FIG. 6A.
Figure 6C:
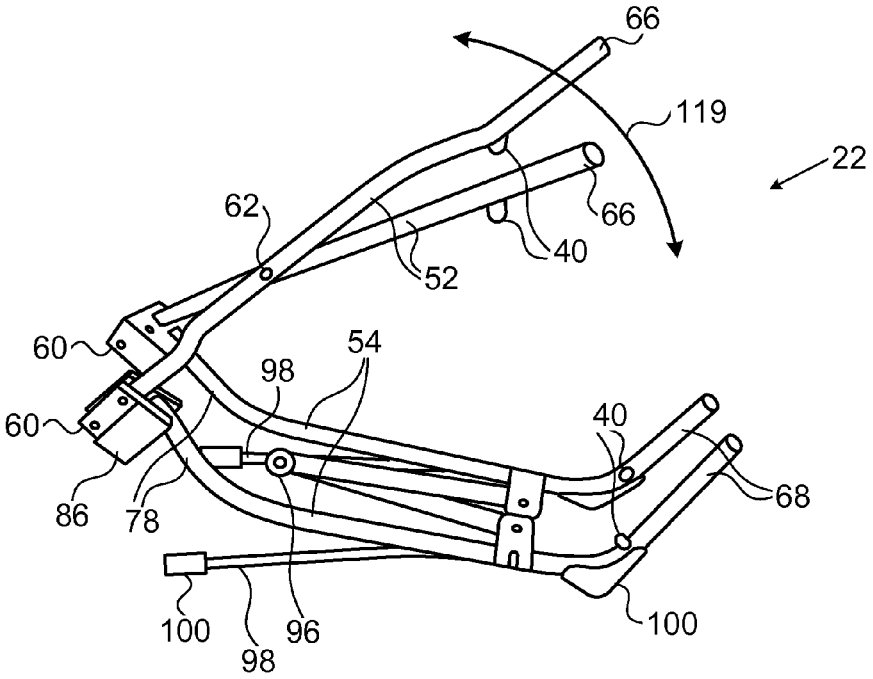
FIG. 6C is a side view of the support assembly illustrating a further sequence of folding.
Figure 6D:
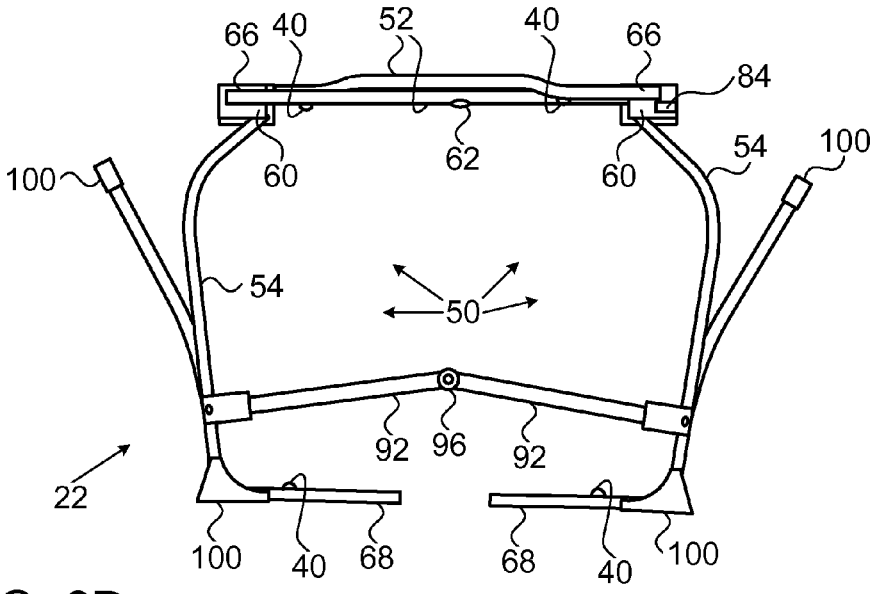
FIG. 6D is a top view of the support assembly at a semi folded position, with the links extending substantially coplanar.
Figure 7:
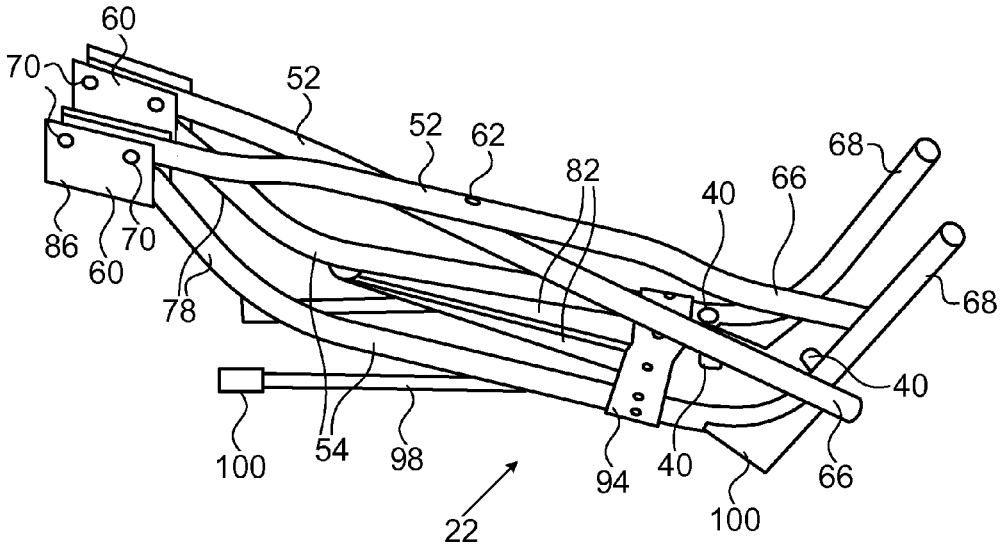
FIG. 7 illustrates the support assembly of the bouncer, at a fully collapsed position.
Figure 8A:
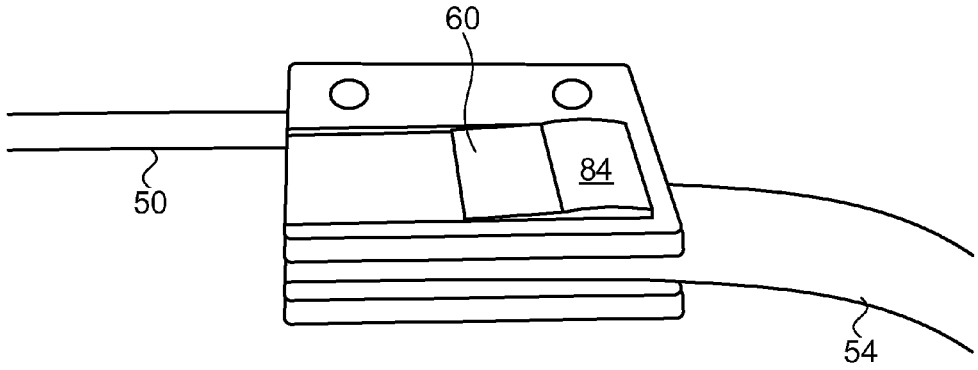
FIG. 8A illustrates a folding joint of the bouncer, with the articulated links arrested at the fully open position.
Figure 8B:
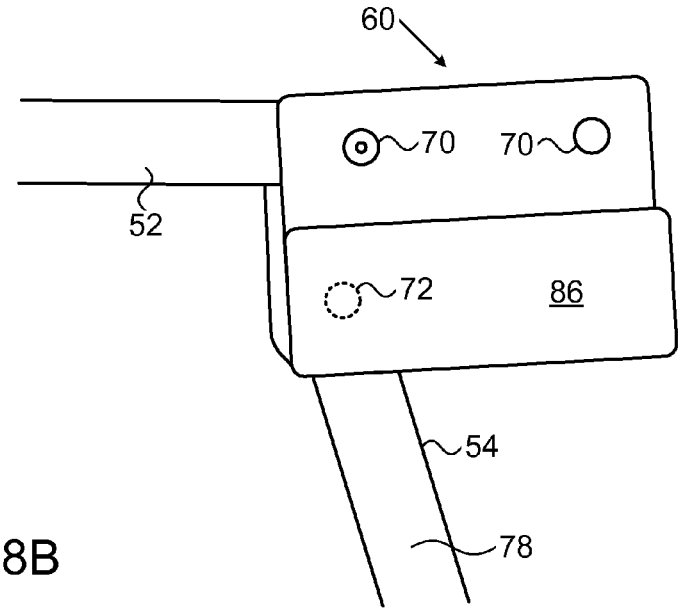
FIG. 8B illustrates the folding joint of FIG. 8A, with the articulated links arrested at the fully folded position.
Figure 8C:
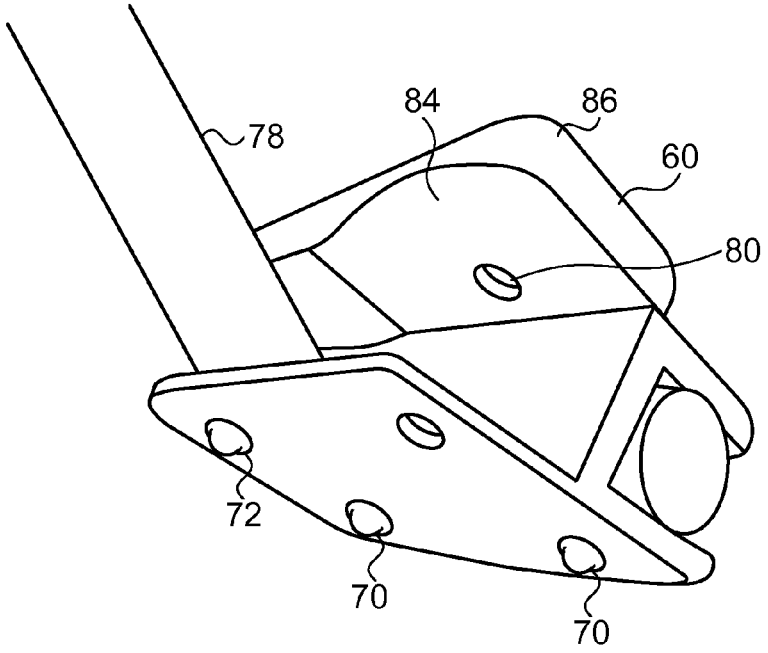
FIG. 8C and 8D illustrate the folding joint of FIG. 8A, with the articulated top link at an intermediate, unlocked position.
Figure 8D:
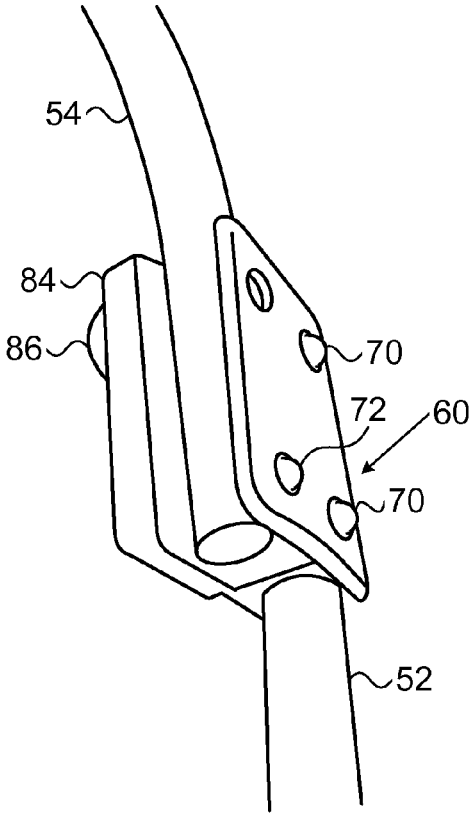

Folding the bouncer 20 takes place by first collapsing the connecting member 90 by folding the support links 92 such that they substantially overlap one another (FIGS. 6A and 6B) whereby the X-shaped structure is collapsed. Then, support rods 50 are collapsed by depressing the depression bar 86, such that the top links 52 are folded (arrowed line 119 in FIG. 6C) over the bottom links 54, and the bottom links 54 of the support rods 50 are adjoined and substantially parallel disposed (FIG. 7). Deploying the bouncer into its open position takes place in a reverse sequence.

Further attention is now directed to FIGS. 10 to 16, directed to yet another example of a bouncer according to the present disclosed subject matter. The bouncer 220 is similar to that disclosed in the previous drawings, however with some different configurations associated with the folding/unfolding mechanism. For sake of clarity, like elements are designated with like reference numbers, however shifted by 200.

The bouncer 220 has the same general structure as discussed hereinabove and comprises a support assembly 222 and a seating member 224 (shown only in FIGS. 10 and 11) mounted over the support structure 222. Configuration and function of the support assembly 222 and the seating member 224 are substantially as discussed above.

The support assembly 222 comprises two support rods 250 each configured as a J-like shaped member and comprising a top link 252 and a U-like bottom link 254 coupled to one another about a folding joint 260 to be discussed hereinafter in further detail. The two support rods 50 are pivotally secured to one another at 262 such that at an open position the top links intersect at an X-like configuration. The support rods 250 are made of a rigid, light weight material, e.g. metal, reinforced plastic material, carbon, etc.

The support structure 222 further comprises two support links 292 extending adjacent the free ends 268 of the bottom links 254, said support links 292 bring pivotally articulated to the respective bottom links 254 via a coupler link 293 imparting said support links 292 with pivotal freedom and some tilt freedom as represented by arrows 295 and 297 in the drawings. The two support links 292 are pivotally secured to one another via a locking mechanism 296. Said support links 292 are deployable between a collapsed position at which they at least partially overlap, and an open position at which they substantially coextend.

The two support links 292 on the one hand restrict expansion of the two support rods 250 at the open position of the bouncer and on the other hand retain it fixedly open and prevent spontaneous collapsing.

The support structure 250 is thus configured with two top free ends 266 (of top links 522) and two bottom free ends 268 (of bottom links 254), said free ends configured, according to some examples, with an end piece 265 and are configured for arresting within the receiving pockets of the seating member 224 (not shown), or otherwise, as known per-se. The seating member 224 is further articulated to the support structure 250 by virtue of a plurality of hooks 231 disposed over portions of the links and rods (e.g. seen in FIG. 14D) with respective loops formed at the seating member 224 (not seen).

As can be seen in the drawings, at the open position of the support structure 222, the bottom free ends 268 of bottom links 254 extend substantially upright, however with a somewhat outwards oriented inclination.

The arrangement is such that the top link 252 is fixedly secured to the folding joint 260 (e.g. by a fastener at 265), with the bottom link 254 articulated to a coupler 269 (e.g. by a fastener at 267), the later pivotally secured to the joint 260.

The seating member 224 and the corresponding free ends 266 and 268 of support rods 250 are mutually shaped and sized such that at the open position the flexible seating member 224 is substantially stretched and assumes a seating shape, configured for comfortably seating an infant therein, and at the collapsed position (FIG. 11), the bouncer is collapsed/folded and the support structure 222 with the articulated seating member 224 fold into a compact size to occupy minimal space.

In order to impart the bouncer 220 with some bouncing elasticity, for a rendering it a soothing effect, a pair of springy supports 298 are attached to the bottom links 254, to thereby facilitate gentle rocking of the bouncer.

A free end of said springy supports 298 and a floor point of contact at the bottom link is configured with a floor pad 300, e.g. made of rubber material or plastic, serving as an anti-slip and anti-scratch pad.

It is however appreciated that rather than supports 298, other configurations are possible, e.g. a resilient projection extending from or near each of the joints 260 (e.g. articulated to the bottom links 254), etc.

According to the illustrated example, the bouncer is configured with two unlocking arrangements, whereby collapsing the bouncer 220 requires two unlocking procedures, as will be discussed hereinafter in detail. The unlocking procedures, in the particular example, are performed simultaneously, though in-series operation can be performed as well.

As can best be seen in FIGS. 14A to 14D, a first locking mechanism 296 comprises a housing 348 accommodating a first ring portion 350 integral with and fixed at an end of the right support link designated herein 292A, and a second ring portion 352 integral with and fixed at an end of the left support link designated herein 292A. A plunger 356 is retained in the housing and is spring biased by a coiled spring 358 between a normally projecting position (FIG. 14A), and a depressed position (FIGS. 14B and 14D) against the biasing effect of the spring 358. A plunger stem 360 is configured at a top end thereof with locking prongs 364. Both the first ring portion 350 and the second ring portion are configured with axially disposed recesses 370 facing each other and coextending, and further configured for mutual arresting by the locking prongs 364.

The arrangement is such that the locking prongs 364 are normally biased into locking engagement with the axially disposed recesses 370 of the two ring portions 350 and 352, thereby arresting the at a respective open position (FIG. 14A), or at a respective collapsed position (FIG. 14C) wherein the two rings are arrested and cannot pivot with respect to one another (whereby the respective right support link 292A and the left support ling 292B become arrested at their expanded, open position. However, upon depressing the plunger 356 in direction of arrow 361 against the spring 358, the locking prongs 364 disengage from the recesses 370, thereby facilitating pivotal displacement of the two ring portions 350 and 352 with respect to one another and respectively of the right support link 292A and the left support ling 292B) into collapsing the bouncer.

Figure 14A:
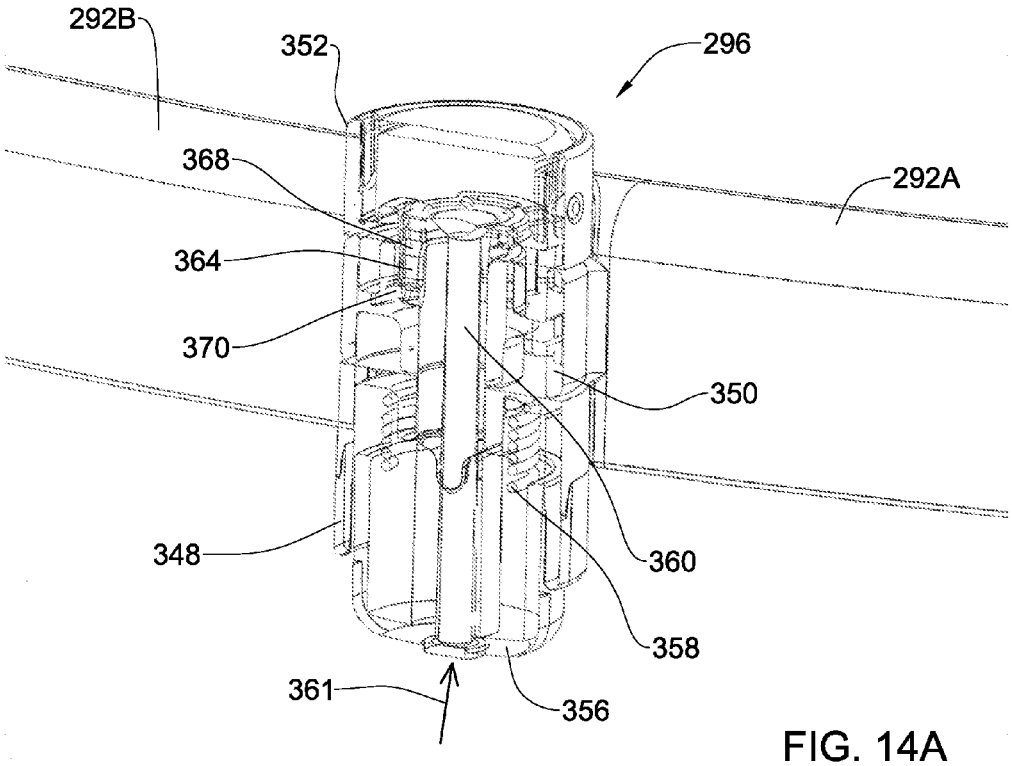
FIG. 14A is a section along line I-I in FIG. 12A, illustrating the support links locking mechanism at a locked position.
Figure 14B:
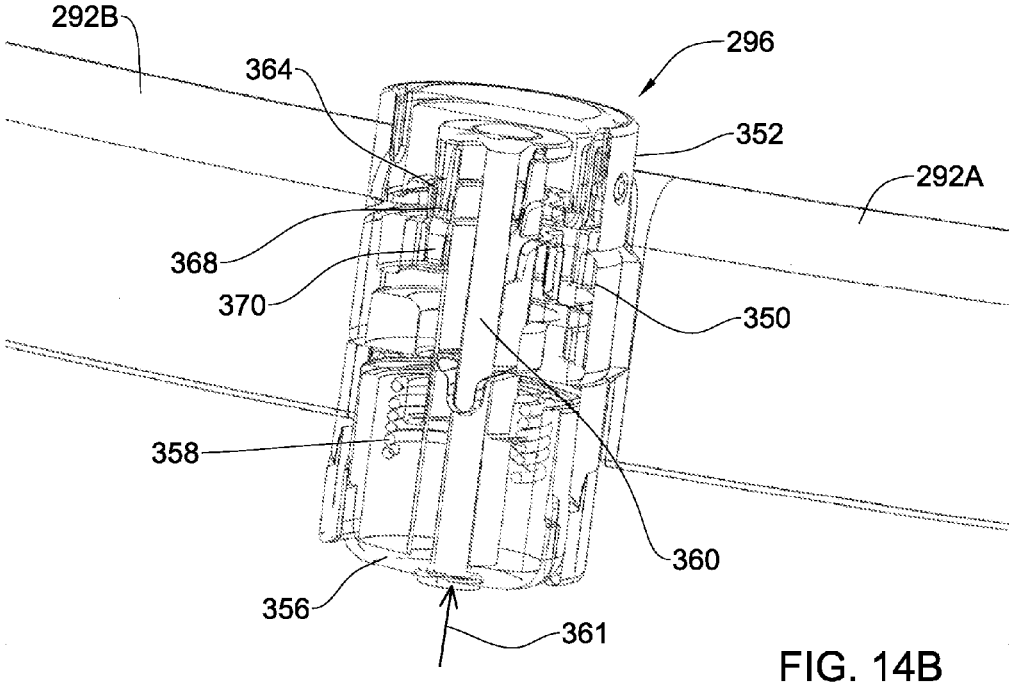
FIG. 14B illustrates the mechanism of FIG. 14A at its unlocked position.
Figure 14D:
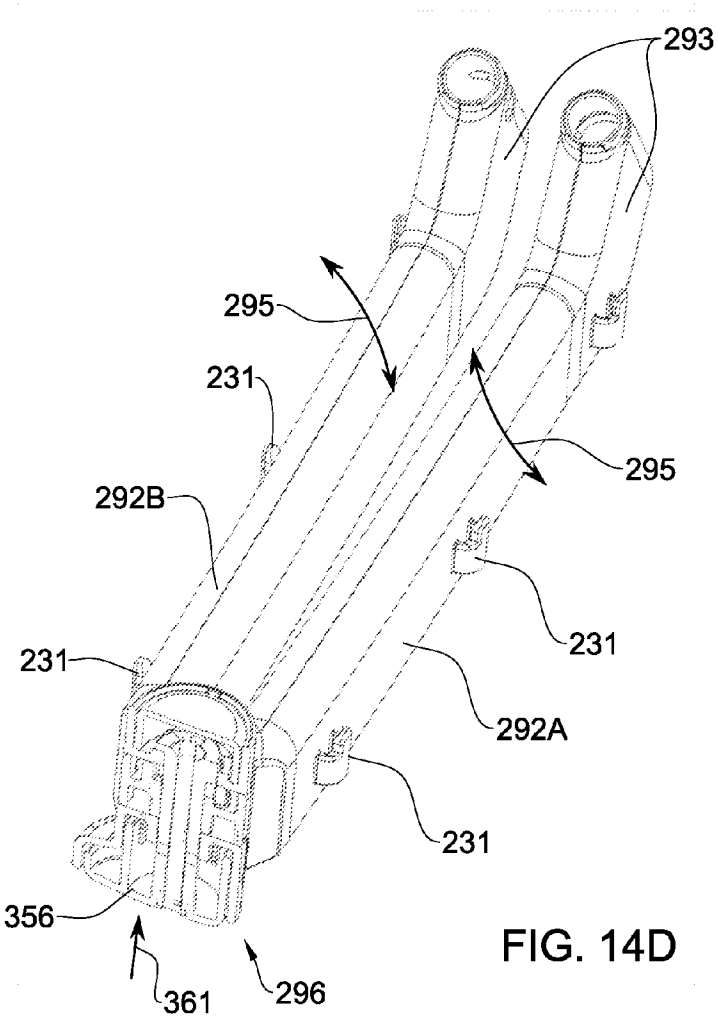
FIG. 14D a section along line II-II in FIG. 14C.
Figure 14C:
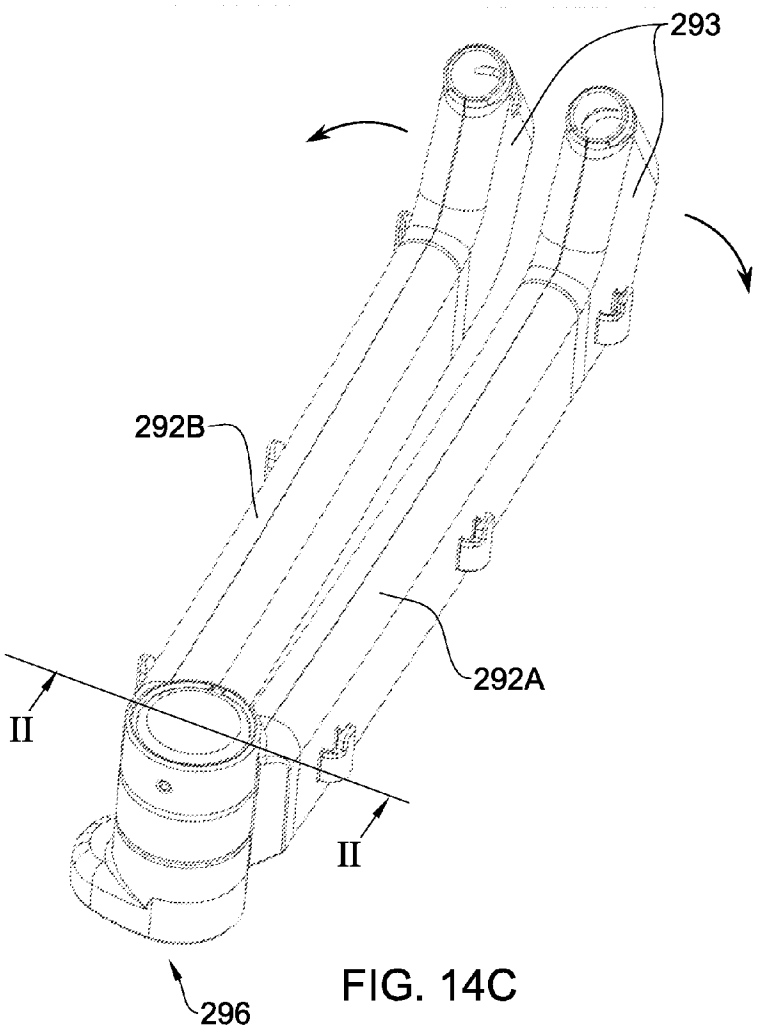
FIG. 14C illustrates the support links at their folded position.
Figure 15A:
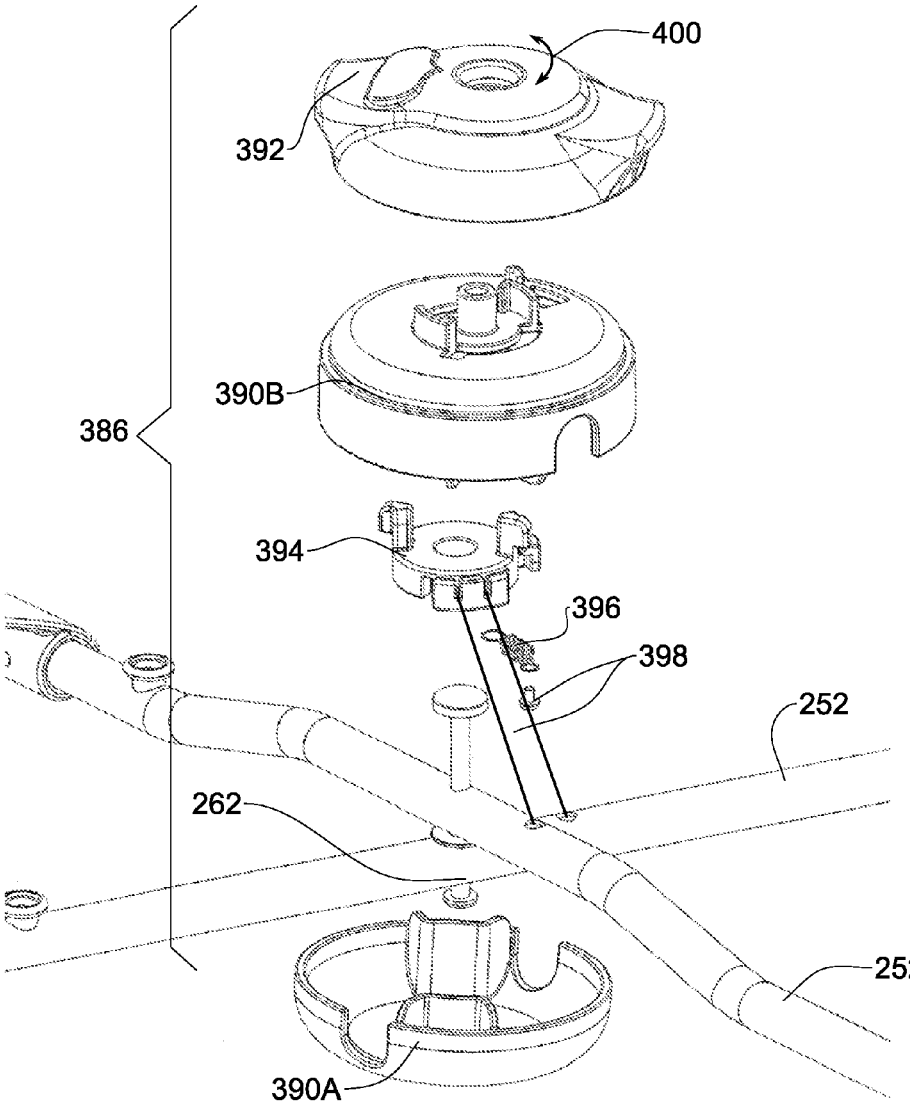
FIG. 15A is an exploded isometric rear view of an unlocking mechanism of the bouncer.
Figure 15B:
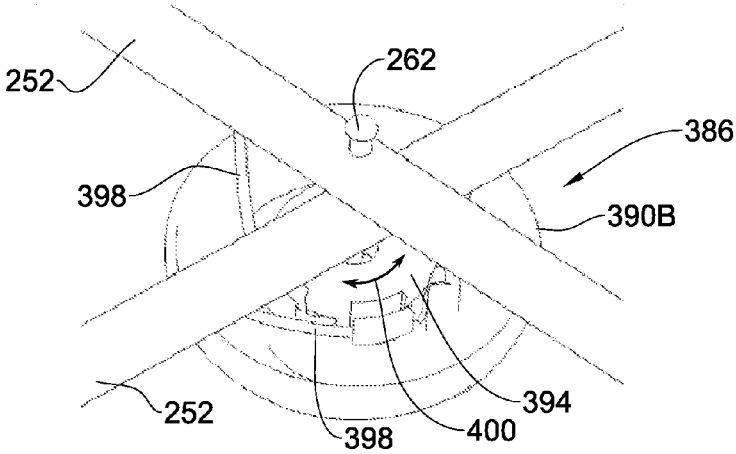
FIG. 15B is a rear view, partially assembled, of the unlocking mechanism of FIG. 15A.
Figure 16B:
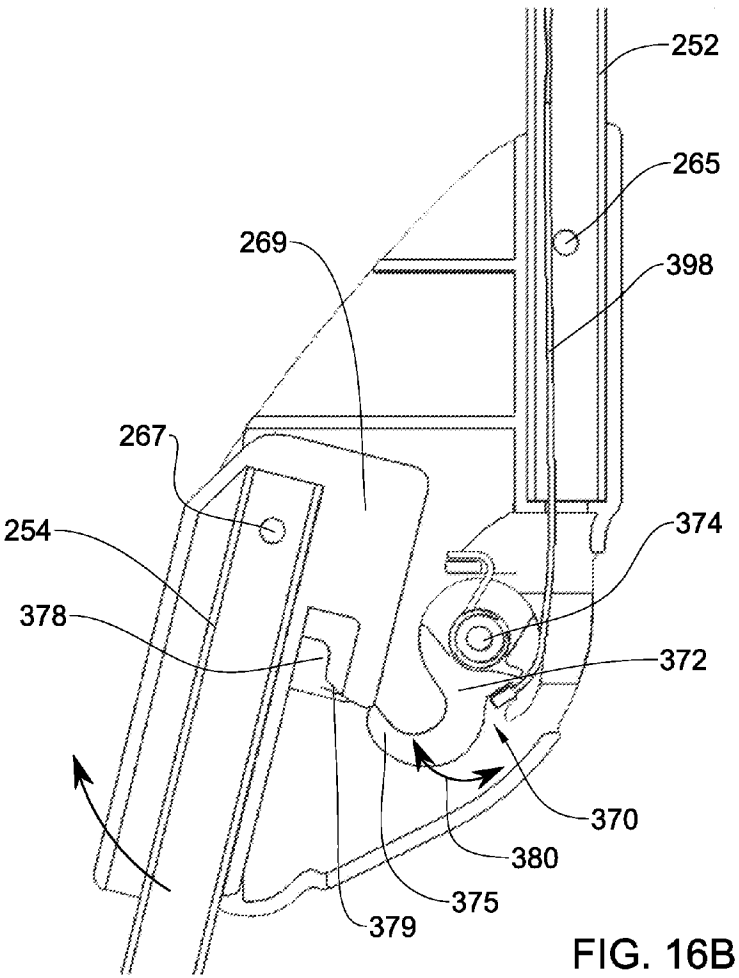
FIGS. 16A to 16E are sections through the folding joint, illustrating consecutive steps of unlocking same.
Figure 16A:
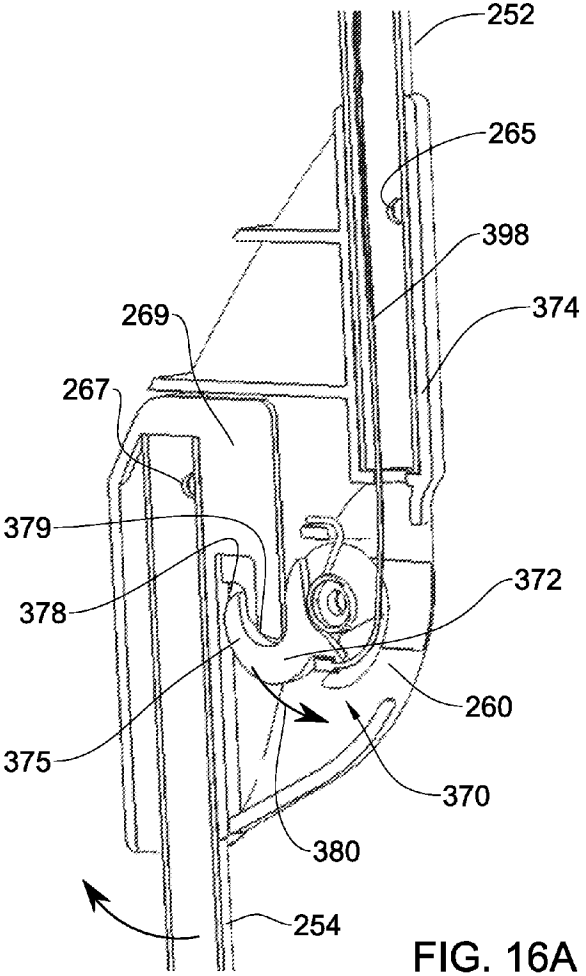
Figure 16D:
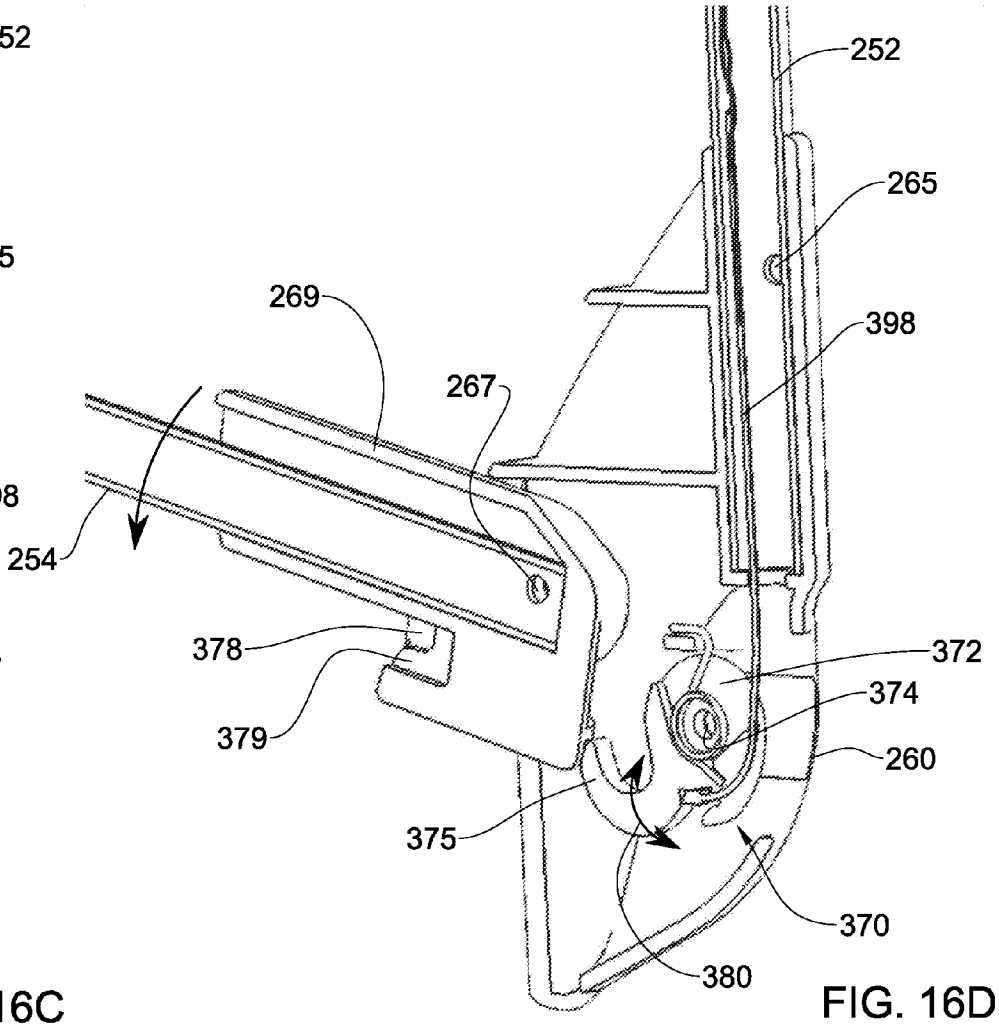
Figure 16C:
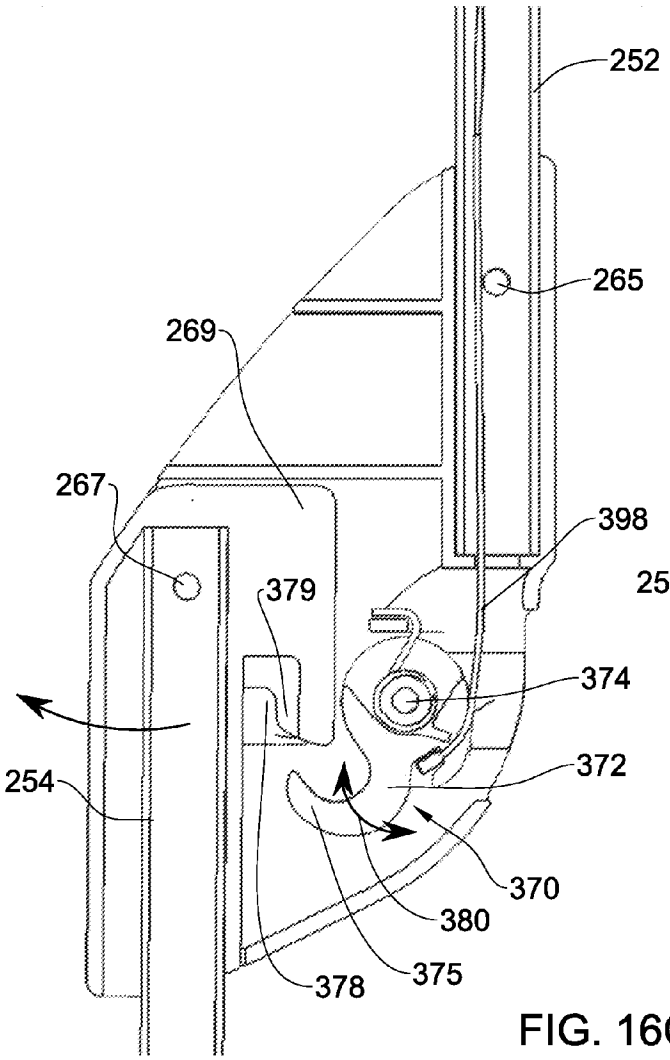
Figure 16E:
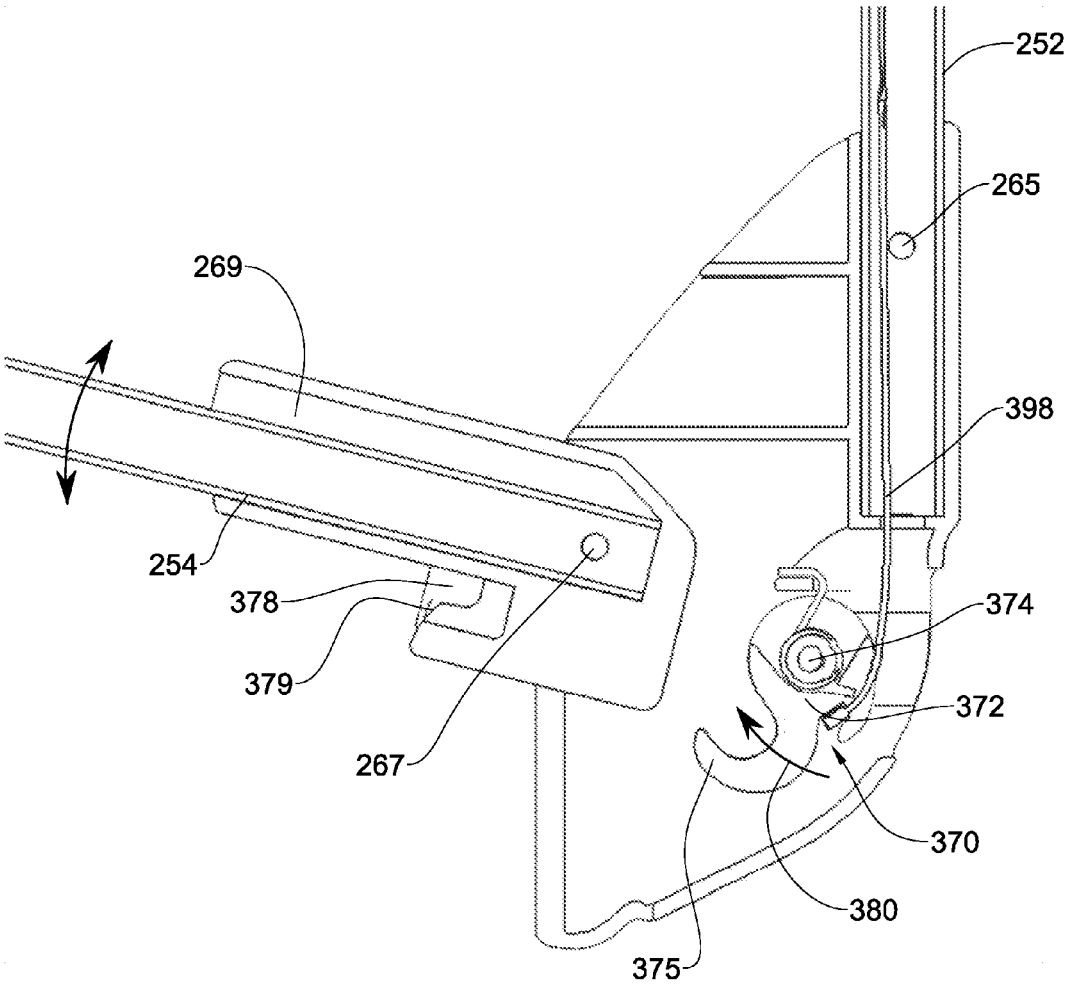

In a particular example, the two ring portions 350 and 352 are arrested also at the collapsed position of the bouncer, namely where the right support link 292A are pivoted and extend substantially parallel to one another, e.g. in FIGS. 14C and 14D), whereby deploying the bouncer into its open position requires depressing the plunger 356 to disengage pivotal arresting of the two ring portions 350 and 352, as discussed hereinabove. However, according to a different configuration, deploying the bouncer into its open position merely requires pulling out of the right support link 292A and the left support ling 292B.

A second locking mechanism is provided for arresting the bottom links 254 at the open position, i.e. substantially in continuity with the top links 252. For that purpose, there is provided an arresting mechanism generally designated 370 (shown in FIGS. 16A to 16E), wherein the folding joint 260 accommodates a locking member 372 pivotally articulated with folding joint 260 at 374 and configured with an arresting hook 375. The bottom link 254 is fixedly articulated to the coupler 269, the later configured with an arresting portion 378.

The arrangement being such that the arresting hook 375 is configured for pivotal displacement as represented by arrowed line 380 between an engaged position wherein the arresting hook 375 is arrestingly received within the arresting portion 378 (FIG. 16A) corresponding with an open, deployed position of the bouncer 220 wherein the bottom link 254 is locked with at the deployed, open position with respect to the top link 252, and an un-arrested position corresponding with a folding position of the bouncer (FIGS. 16B to 16E), wherein the bottom link 254 is pivoted/folded with respect to the top link 252.

As seen in the drawings, the arresting hook 375 and the respective arresting portion 378 are configured with smooth curved/chamfered gliding surfaces 379 to facilitate smooth displacement of the arresting hook 375 into arresting engagement with the arresting portion 378.

Pivotal displacing the arresting hooks 375 from their arrested position into the unlocked position is facilitated through an unlocking mechanism 386 (FIGS. 15A and 15B) mounted at the pivot coupling location 262 of the two top links 252. The unlocking mechanism 386 comprises a housing composed of two shell members 390A and 390B, a rotary manipulating dial 392 articulated to a winder 394 pivotally secured within the housing and spring biased by a tension spring 396. Two tension cords 398 are secured to the winder 394 and extend into the respective top links 252 extending through the hollow links to the folding joint 260 and fixedly articulated to the hook-like locking member 372 (see also FIGS. 16A to 16E).

The pivotal locking members 372 are thus normally biased into a normally locked position by spring 396 (secured at one end to the winder 394 and an opposite end to a fixed portion of the housing 390 or to a top link 252).

The arrangement is such that manipulating the unlocking mechanism 386, namely rotating the dial 392 in either direction represented by arrowed line 400, entails simultaneous tensioning of the two cables 398, resulting in simultaneous pivotal displacement of the locking members 372 into their temporarily unlocked position, facilitating folding of the bouncer 220, whereby releasing the dial 392 results in spontaneous displacement of the locking members 372 into their snappingly arresting position, readily positioned for arresting and locking engaging with the coupler 269.

The invention claimed is:

1. An infant bouncer, comprising:

a support assembly configured with a pair of support rods pivotally articulated to one another, each of the support rods configured with at least a top link and a bottom link foldable about a folding joint, the top links of the support rods being retained at an intersecting configuration, the intersected top links of the support rods defining a first plane and the bottom links of the support rods defining a second plane different from the first plane; and a flexible seating member mounted on the support assembly;

wherein the infant bouncer is configurable between an open position in which the first plane creates a first angle with respect to the second plane, and a collapsed position in which the first plane creates a second angle with respect to the second plane different from the first angle.

2. The infant bouncer according to claim 1, wherein, in the open position, the top link and the bottom link of each support rod are substantially coextensive and, in the collapsed position, the top links are folded over the bottom links, and the bottom links link of the support rods are adjoined and substantially parallel disposed.

3. The infant bouncer according to claim 1, wherein a top portion of the flexible seating member is secured over a free top end of the top links of the support rods, and a bottom portion of the flexible seating member is secured over a free bottom end of the bottom links of the support rods.

4. The infant bouncer according to claim 1, wherein one of the top link or the bottom link is configured for snap locking at the folding joint in either or both of an open position in which the top link and the bottom link substantially coextend, and the collapsed position.

5. The infant bouncer according to claim 1, wherein the folding joint includes a safety arresting mechanism to prevent unintended collapsing of the links.

6. The infant bouncer according to claim 1, wherein the folding joint includes a gliding surface configured for smooth displacement of a locking mechanism of one of the top link or the bottom link over a wall surface of the folding joint.

7. The infant bouncer according to claim 1, wherein a joint end of both the top link and the bottom link of a support rod are pivotally secured to the folding joint, displaceable between an open position in which the top link and the bottom link substantially coextend, and the collapsed position.

8. The infant bouncer according to claim 1, further comprising springy supports that facilitate gentle bouncing of the infant bouncer.

9. The infant bouncer according to claim 1, further comprising a connecting member that extends between a portion of each of the two bottom links to restrict expansion of the two support rods at the open position of the bouncer.

10. The infant bouncer according to claim 9, wherein the connecting member includes a strap of flexible material extending between a bottom portion of the bottom links.

11. The infant bouncer according to claim 9, wherein the connecting member includes two or more support links pivotally secured to a bottom location of bottom links and to one another, the support links deployable between a collapsed position at which they at least partially overlap, and an open position at which they substantially coextend.

12. The infant bouncer according to claim 11, wherein the support links include a locking mechanism for arresting the connecting member at the open position, to thereby retain the bouncer at the open position and prevent spontaneous folding thereof.

13. The infant bouncer according to claim 1, wherein the folding joint is configured for arresting the top and bottom links at the open position by a normally locked arresting mechanism, such that when deployed at the fully open position the top link and the bottom link become a rigid element' substantially continuous with one another.

14. The infant bouncer according to claim 13, wherein the arresting mechanism is configured as a hooked member articulated with one of the top link and the bottom link, and configured for arresting a respective recess configured at the other one of the top link and the bottom link.

15. The infant bouncer according to claim 13, wherein an unlocking mechanism is configured at a pivot location of the two respective top links, said unlocking mechanism configured for simultaneous manipulating of the arresting mechanism at the folding joints.

16. The infant bouncer according to claim 15, wherein displacement of the pivoting hook members by the unlocking mechanism is facilitated by a cord member articulated to the hook members and to the unlocking mechanism, whereby manipulating the unlocking mechanism entails temporarily unlocking of the hook members so as to disengage from the respective arresting recess.

17. The infant bouncer according to claim 16, wherein manipulating the unlocking mechanism is facilitated by rotating a manipulator to pull a cord, said cord extending through at least a portion of the top links.

18. The infant bouncer according to claim 16, wherein the pivoting hook members and/or the respective arresting recess include gliding surfaces to facilitate smooth displacement of the hook members into arresting engagement of the arresting recess.

19. The infant bouncer according to claim 16, wherein the pivoting hook members are biased into their locking position.

20. A support assembly for an infant bouncer, the support assembly comprising:

a pair of support rods pivotally articulated to one another, each of the pair of support rods configured with at least a top link and a bottom link foldable about a folding joint, the top links of the pair of support rods being retained at an intersecting configuration, the intersected top links of the support rods defining a first plane and the bottom links of the support rods defining a second plane different from the first plane; and wherein the infant bouncer is configurable between an open position in which the first plane creates a first angle with respect to the second plane, and a collapsed position in which the first plane creates a second angle with respect to the second plane different from the first angle.

* * * * *